US006502805B2

(12) United States Patent
Lewis et al.

(10) Patent No.: US 6,502,805 B2
(45) Date of Patent: Jan. 7, 2003

(54) SHEET-METAL HIGHWAY GUARDRAIL SYSTEM

(76) Inventors: David R. Lewis, 263 Bradford Dr., Canfield, OH (US) 44406; William Atwood, Rte. 2, Box 292, Kosciusko, MS (US) 39090-0930; David A. Hubbell, 112 Park Ave., Saranac Lake, NY (US) 12983

( * ) Notice: Subject to any disclaimer, the term of this patent is extended or adjusted under 35 U.S.C. 154(b) by 0 days.

(21) Appl. No.: 09/754,096

(22) Filed: Jan. 5, 2001

(65) Prior Publication Data

US 2002/0088967 A1 Jul. 11, 2002

(51) Int. Cl.[7] ..... A01K 3/00

(52) U.S. Cl. ..... 256/13.1; 256/1; 256/DIG. 5; 404/6

(58) Field of Search ..... 256/13.1, 21, 19, 256/1, DIG. 5; 404/6, 9, 10

(56) References Cited

U.S. PATENT DOCUMENTS

| | | | | | |
|---|---|---|---|---|---|
| 518,645 | A | | 4/1894 | Crittenden et al. | |
| 523,075 | A | | 7/1894 | Krause | |
| 1,759,794 | A | | 5/1930 | McDade | |
| 2,007,466 | A | | 7/1935 | Campbell | |
| 2,056,858 | A | | 10/1936 | Irons et al. | |
| 2,067,887 | A | * | 1/1937 | Camp | 256/13.1 |
| 2,078,704 | A | * | 4/1937 | Baxter | 256/13.1 |
| 2,136,415 | A | | 11/1938 | Cornett | |
| 2,160,519 | A | | 5/1939 | Robertson | |
| 2,166,097 | A | | 7/1939 | Kotrbaty | |
| 2,178,762 | A | | 11/1939 | McLaughlin | |
| 2,238,523 | A | * | 4/1941 | Holst | 256/13.1 |
| 2,296,419 | A | | 9/1942 | Camp | |
| 2,642,269 | A | * | 6/1953 | Daniel | 256/21 |
| 2,740,613 | A | * | 4/1956 | Berliner | 256/21 |
| 3,270,480 | A | | 9/1966 | Beecker | |
| 3,305,221 | A | * | 2/1967 | Kling | 256/21 |
| 3,328,931 | A | | 7/1967 | Smith | |
| 3,332,666 | A | * | 7/1967 | Gray | 256/13.1 |
| 3,410,995 | A | | 11/1968 | Gray | |
| 3,467,361 | A | | 9/1969 | Moschettini | |
| 3,519,249 | A | | 7/1970 | Nave | |
| 3,704,861 | A | * | 12/1972 | Glaesener | 256/13.1 |
| 3,728,837 | A | * | 4/1973 | Kiefer, Jr. | 256/DIG. 5 X |
| 3,807,699 | A | | 4/1974 | France | |
| 3,981,486 | A | | 9/1976 | Baumann | |
| 4,007,917 | A | | 2/1977 | Brubaker | |
| 4,222,552 | A | | 9/1980 | Matteo, Sr. | |
| 4,240,615 | A | * | 12/1980 | Sickler | 256/DIG. 5 X |
| 4,364,546 | A | * | 12/1982 | Lyman et al. | 256/DIG. 5 X |

(List continued on next page.)

FOREIGN PATENT DOCUMENTS

WO WO 99/61708 12/1999

*Primary Examiner*—Lynne H. Browne
*Assistant Examiner*—John Cottingham
(74) *Attorney, Agent, or Firm*—Shlesinger, Arkwright & Garvey LLP

(57) ABSTRACT

A highway guardrail system comprises a plurality of posts; a plurality of spacers attached to respective posts; and a rail attached to the spacers. The post comprises a tube formed from sheet material, including overlapping portions facing toward the highway when installed; and a plurality of connectors to join said overlapping portions together. The spacer comprises a member formed from sheet metal blank including a rail attachment portion, a post attachment portion and a bridge portion connecting said rail and post attachment portions. The rail attachment portions and the bridge portion form an acute angle in plan view; and the bridge portion is tapered from wide to narrow toward the post attachment portion. The rail is tubular formed from sheet metal, including a U-shaped member and a sheet metal plate both having overlapping portions; and a plurality of connectors to join said overlapping portions together.

34 Claims, 19 Drawing Sheets

U.S. PATENT DOCUMENTS

| | | | | | |
|---|---|---|---|---|---|
| 4,459,735 | A | | 7/1984 | Sawdon | |
| 4,638,979 | A | | 1/1987 | Demarest | |
| 4,662,611 | A | | 5/1987 | Ruane | |
| 4,739,971 | A | | 4/1988 | Ruane | |
| 4,757,609 | A | | 7/1988 | Sawdon | |
| 4,910,853 | A | | 3/1990 | Sawdon | |
| 4,982,931 | A | | 1/1991 | Pomero | |
| 5,033,905 | A | | 7/1991 | Schmidt et al. | |
| 5,069,576 | A | | 12/1991 | Pomero | |
| 5,172,891 | A | | 12/1992 | Chen | |
| 5,195,727 | A | | 3/1993 | Liao et al. | |
| 5,219,241 | A | | 6/1993 | Picton | |
| 5,229,051 | A | | 7/1993 | Martin | |
| 5,261,647 | A | | 11/1993 | Venegas, Jr. et al. | |
| 5,275,382 | A | | 1/1994 | Charbaut et al. | |
| 5,286,137 | A | | 2/1994 | Cicinnati et al. | |
| 5,336,016 | A | | 8/1994 | Baatz | |
| 5,402,987 | A | | 4/1995 | Duyck et al. | |
| 5,429,449 | A | | 7/1995 | Baatz | |
| 5,462,258 | A | | 10/1995 | Gaillard et al. | |
| 5,494,261 | A | * | 2/1996 | Gandara | 256/DIG. 5 X |
| 5,507,473 | A | | 4/1996 | Hammer et al. | |
| 5,553,437 | A | | 9/1996 | Navon | |
| 5,657,966 | A | | 8/1997 | Cicinnati | |
| 5,660,375 | A | | 8/1997 | Freeman | |
| 5,860,636 | A | * | 1/1999 | Duncan et al. | 256/DIG. 5 X |
| 5,876,020 | A | | 3/1999 | Giavotto | |

* cited by examiner

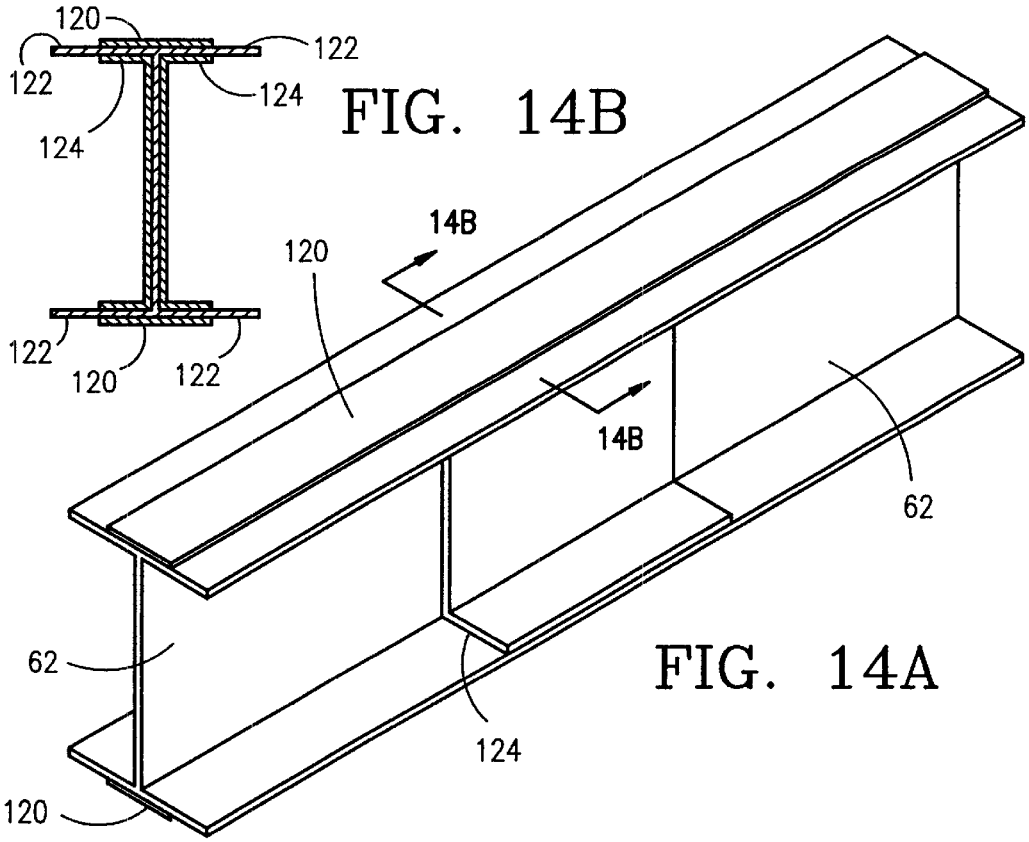
FIG. 14B
FIG. 14A
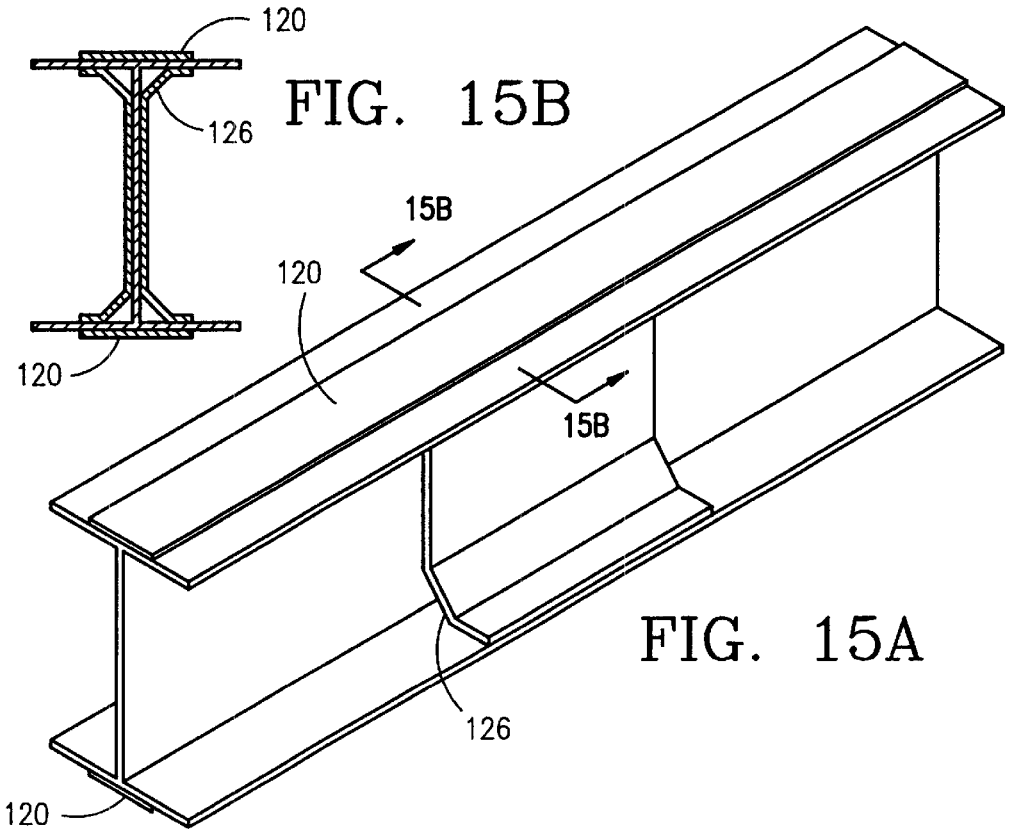
FIG. 15B
FIG. 15A

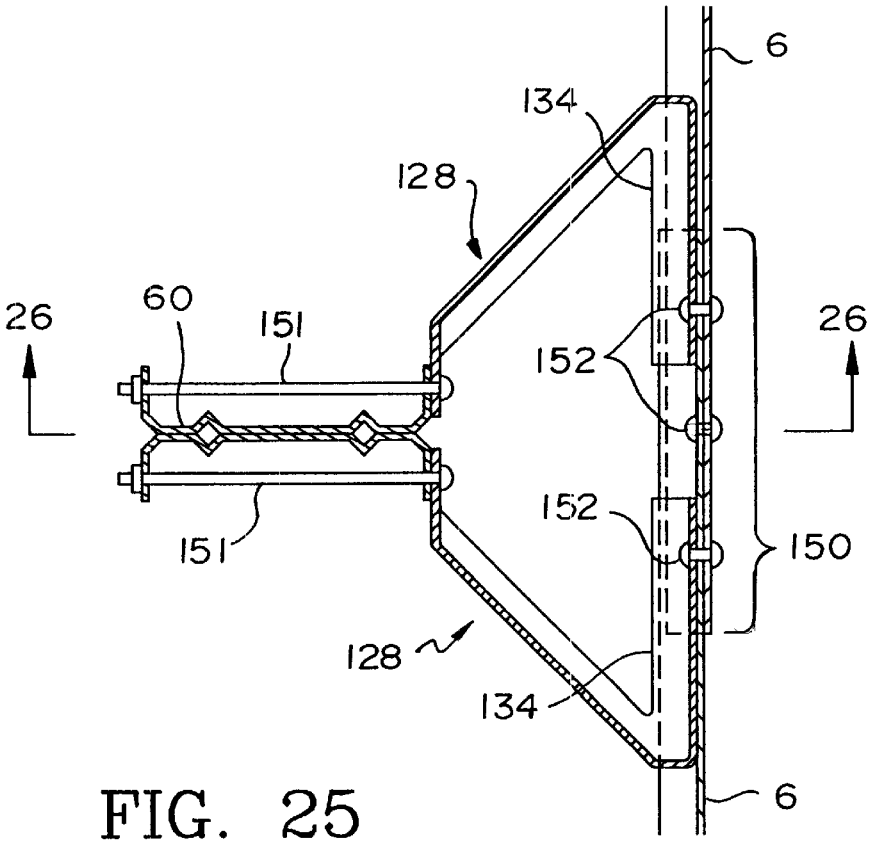
FIG. 25
FIG. 26
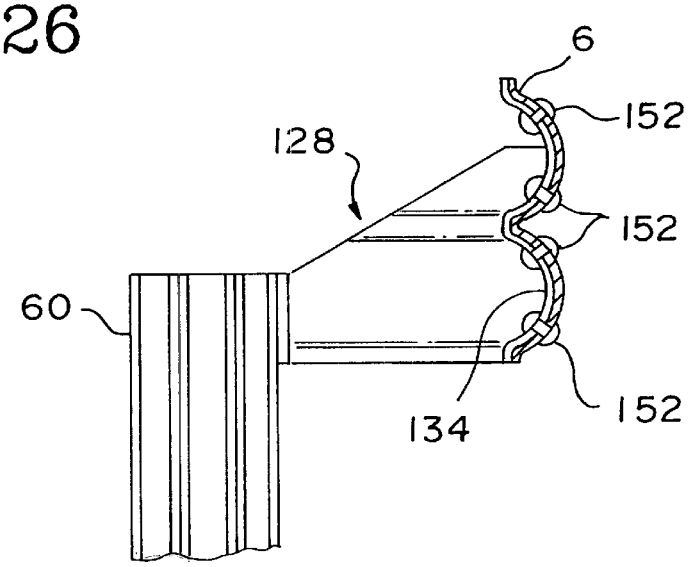

SHEET-METAL HIGHWAY GUARDRAIL SYSTEM

FIELD OF THE INVENTION

The present invention is generally directed to cantilevered structural supports, such as guardrail structural systems designed for predominately lateral loadings imposed by impacting vehicles or other sources, such as snow-plowing operations, and specifically to highway guardrail systems made from sheet metal.

BACKGROUND OF THE INVENTION

Design of structures where lateral forces predominate are encountered in structural systems such as highway guardrail systems and sheet-piling. In these cases, use of hot-rolled steel structural shapes is the prior art. However, in general, cold-form structural shapes from sheet steel provides for lesser cost per pound of material. Design using sheet steel is limited, however, due to readily available thicknesses which tend to be relatively thin when compared to thicknesses vailable from hot-rolled steel structural shape sources.

Fabricating structures designed for lateral loads usually requires fabrication methods that included welding. Government agencies and engineering design firms usually put such significant welding activities under quality-control requirements, such as fabrication shop's certification, individual welding employee certifications, welding equipment checks and certifications, limits on the types and specifications of steel to be welded and post-fabrication testing of weldments and heat-zone base metal.

The prior art guardrail system uses a standard W6×8½ wide-flange steel beam as a highway guardrail post. Focusing on the strong-post, blocked-out W-beam Systems's post component, the standard W-beam post consists of a hot-rolled, wide-flange steel beam with a designation of "W6×8½". This W6×8½ post is punched (usually 7 " from the post's top to receive a post-thru-bolt, also known as the thru-bolt, post-bolt, block-bolt, railbolt or carriage-bolt. The post-bolt is the structural connection between and attaching the guardrail systems's horizontal rail component, thru the spacer-block, to the post component. After punching, the W6×8½ post is usually hotdipped galvanized. The usual post length is 6 foot, due in part to concerns about installation site soil-matrix conditions. The usual post spacing along the horizontal rail component, center-to-center, is 6'-3". The typical steel grade requirement is 36 ksi.

The prior art use of the standard wide-flange steel beams of constant cross-section leads to material inefficiency, since the design loads in a strong post cantilevered moment resistive application would not require a constant cross-section, and therefore, constant sectional moduli structural properties.

The prior art strong-post highway guardrail lateral structural support system, also known as strong-post W-beam, is engineered to resist deflection primarily via the post and block components. While the W-beam rail component can act to bridge loads to the nearby post/block structural sub-system by way of beam-action, the prior art W-beam, when loaded to design capacity, quickly deflects and goes into a tension-state much like a span-wire or cable.

On impact with a vehicle, the W-beam, at the point of impact, "hinges". The W-beam sections up-stream from the impact point are put into tension. The W-beam sections down-stream from the impact point are, initially loaded axially. As the impacting vehicle deflects or pushes the guardrail system back from its original line (vertical plane), the W-beam sections nearby are also put into some bending.

The W-beam rail component was institutionalized by State and Federal Transportation agencies in 1956–1957. In addition to the other concerns addressed, the evolved construction and design concepts of present day vehicles vis-a-vis the pre-1956 passenger-vehicles has not been reflected in the standard Strong-Post guardrail systems. Pre-1956 passenger vehicles tended to be "hard-shelled". That is, they were designed, in general, to be rigid boxes with wheels. As such, relatively less stiff crash barriers were designed so as to absorb impacts. The patents for crash barriers pre-1990, in general, discuss providing the shock-absorbing barrier.

Present day passenger vehicles tend to reflect the design concept that the passenger compartment be rigid with the rest of the vehicle sacrificial, that is, crash-able and impact shock-absorbing. Unfortunately, the present day passenger vehicle with the collapsible, shock absorbing front fenders and bumpers, when impacting a standard W-beam, can act to "ramp" the vehicle either up-and-over or down-and-under the W-beam rail until the rigid-structural-components of the passenger compartment engages the rail component. This condition potentially results in pieces of the vehicle's fender and/or bumper protruding past the vertical plane of the W-beam rail and snagging on the post even in low impacts where the guardrail is still upright (not laidback as a result of a high-energy impact or weak soil foundation conditions).

The present invention's rail component addresses present passenger vehicle design resulting in greater safety.

The present invention provides a guardrail system made from sheet metal that addresses the shortcomings of the prior art hot-rolled steel structures.

OBJECTS AND SUMMARY OF THE INVENTION

It is an object of the present invention to provide a post component for cantilevered structural support systems subjected principally to lateral-load conditions, such as guardrail systems, which is more economical to fabricate, transport and/or install than prior art cold rolled wide flange beams.

It is further an object of this invention to provide a post component for cantilevered structural support systems subjected principally to lateral-load conditions, such as guardrail, systems, which is lower cost in maintenance than prior art hot rolled wide flange beams.

It is another object of the present invention to provide a block or spacer component for cantilevered structural support systems subjected principally to lateral-load conditions, such as guardrail systems, which is more economical to fabricate, transport than prior art spacer blocks.

It is a further object of the present invention to provide a block or spacer component for cantilevered structural support systems subjected principally to lateral-load conditions, such as guardrail systems, which is lower cost in maintenance than prior art spacer blocks.

It is still another object of the present invention to provide a spacer component with a structural shape that will structurally yield elastically (without permanent deformation) in the horizontal to assure a more full system response to an impacting object. That is, the present inventions's spacer provides for transfer of force, due to an impacting object, to the next rail element without full development of the post element that the spacer is attached to. This provides for a more system-wide loading and a "softer" load regiment for the post in question versus the prior art localized loading.

It is an additional object of the present invention to provide a rail component for cantilevered structural support systems subjected principally to lateral-load conditions, such as guardrail systems, which is more economical to fabricate, transport and install than prior art rails.

It is an object of the present invention to reduce the generation of scrap material from crashed guardrail systems due to vehicle accidents, resulting in lower economic and/or environmental costs from vehicle accidents.

It is a further object of the present invention to provide individual structural components which may be used interchangeably with existing strong-post guardrail systems. That is, the present invention's post, spacer and rail components may be used with corresponding existing strong-post components.

In summary, the present invention provides a highway guardrail system comprising a plurality of posts; a plurality of spacers attached to respective posts; and a rail attached to the spacers. The post comprises a tube formed from sheet material, including overlapping portions facing toward the highway when installed; and a plurality of connectors to join said overlapping portions together. The spacer comprises a member formed from sheet metal blank including a rail attachment portion, a post attachment portion and a bridge portion connecting said rail and post attachment portions. The rail attachment portions and the bridge portion form an acute angle in plan view; and the bridge portion is tapered from wide to narrow toward the post attachment portion. The rail is tubular formed from sheet metal, including a U-shaped member and a sheet metal plate both having overlapping portions; and a plurality of connectors to join said overlapping portions together.

These and other objects of the present invention will become apparent from the following detailed description.

BRIEF DESCRIPTIONS OF THE DRAWINGS

FIG. 14A is a schematic perspective view of the post of FIG. 11, showing reinforcement plates and nested U-channel members.

FIG. 14B is a cross-sectional view taken along line 14B—14B.

FIG. 15A is a schematic perspective view similar to FIG. 14A, showing a different embodiment for the nested U-channel reinforcement member.

FIG. 15B is a cross-sectional view taken along line 15B—15B of FIG. 15A.

FIG. 25 is a cross-sectional view of through the spacers, showing the connection to the post and to the rails.

FIG. 26 is a schematic cross-sectional view taken along line 26—26 of FIG. 25.

DETAILED DESCRIPTION OF THE INVENTION

Figure 1:
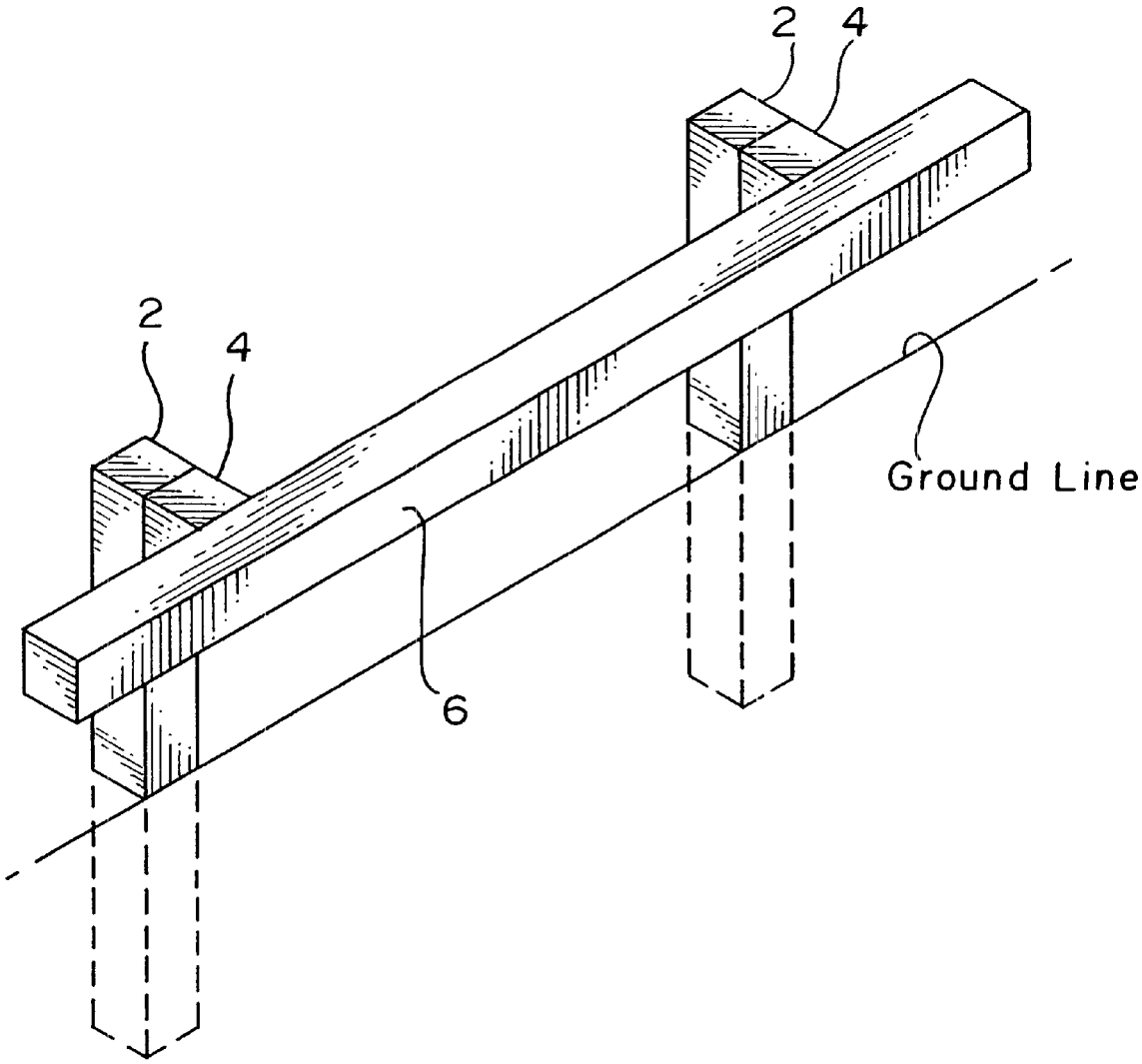
FIG. 1 is a schematic perspective view of a typical guardrail system.

A typical highway guardrail structural system comprises a plurality of posts 2, a plurality of blocks or spacers 4, each secured to a respective post and rails 6, as schematically shown in FIG. 1. The present invention is directed to these various components of the guardrail system.

POST

The post 2 of the present invention is made from sheet metal and formed into a tube of various cross-sectional shapes. Other suitable materials may be used, such as plastic, fiberglass, etc., or combinations thereof. The post 2 of the present invention may be disposed in the ground or secured to a bridge deck.

Figure 2:
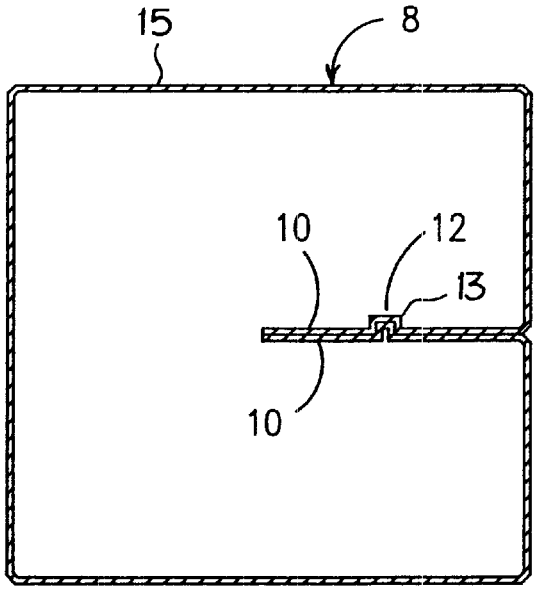
FIGS. 2–6 are cross-sectional views at the ground line of various embodiments of a post made from sheet metal in accordance with the present invention.

Referring to FIG. 2, a tube 8 has a square cross-sectional shape with overlapping portions 10 joined to each other with a plurality of connectors 12 disposed along the length of the tube preferably at regular intervals. The connectors 12 protrude with projections 13 above the planar surface of the sheet metal. The tube 8 is installed with a surface 15 facing toward the traffic side of the roadway. The overlapping portions 10 form an interior vein which provides additional rigidity to the tube. The preferred connectors 12 are described in U.S. Pat. Nos. 4,910,853, 4,757,609 and 4,459,735, which are hereby incorporated by reference, although other means of connection, such as bolts, rivets, welding, etc. may also be used. The projections 13 provided by the connectors 12 advantageously provide shear transfer between the tube and the soil matrix the tube is disposed in.

Figure 3:
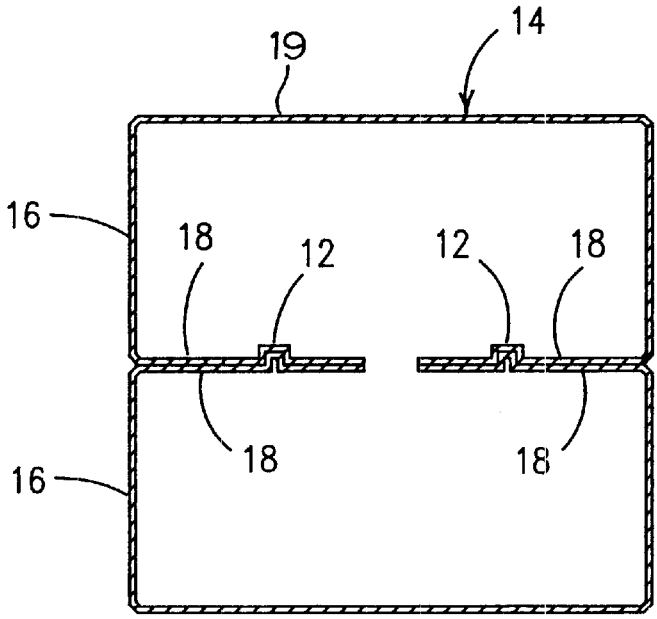
Figure 4:
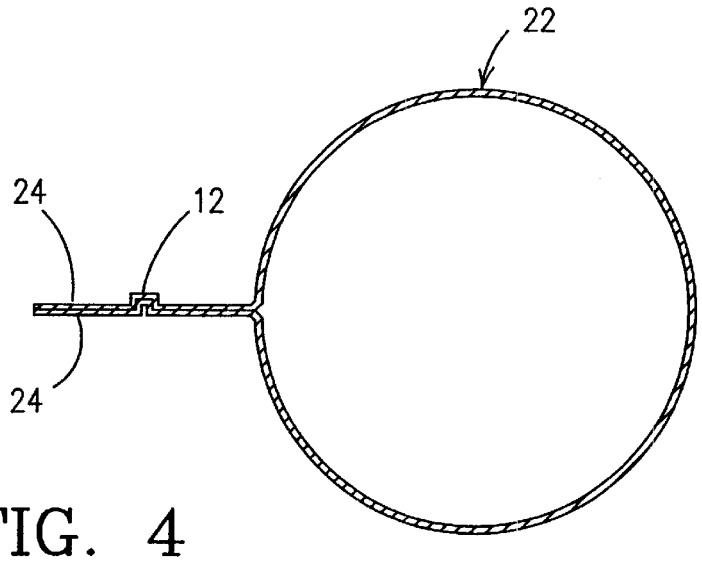

Referring to FIG. 3, a tube 14 is formed from two C-shaped halves 16 and joined together at overlapping portions 18 with a plurality of connectors 12. The overall shape of the tube 14 is a rectangle. The overlapping portions form interior veins to provide additional rigidity to the structure. The tube 14 has a surface 19 directed toward the traffic side of the roadway when installed.

A tube 22 substantially circular, oval or elliptical in cross-section is formed from sheet metal joined together at overlapping portions 24 with a plurality of connectors 12. The overlapping portions 24 form a vein that provide additional rigidity to the tube. The tube 22 is preferably installed with the overlapping portions 24 are disposed substantially transversely toward the traffic side of the roadway. The overlapping portions 24 may be used to secure a block 4.

Figure 5:
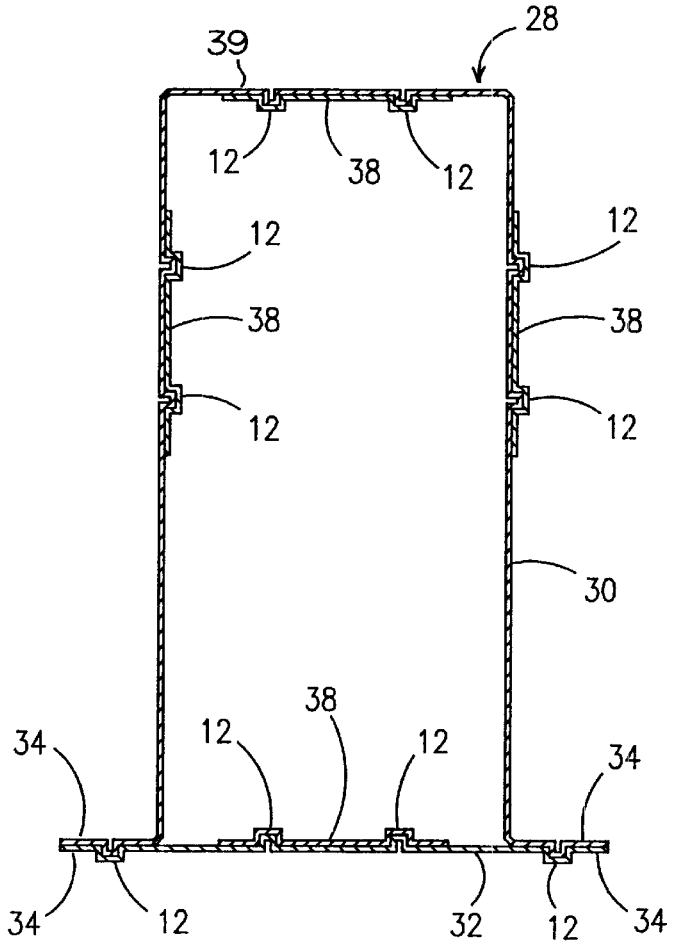

FIG. 5 shows another tube 28 formed from a U-shaped sheet metal member 30 and a flat sheet metal member 32. Overlapping portions 34 are joined together with a plurality of connectors 12 to form a closed cross-sectional shape. Plates 38 are secured to the respective sides of the tube 28 with connectors 12 to provide reinforcement to the tube. The plates 38 are preferably shorter than the length of the tube and are secured substantially at the middle portion of the tube, approximately from below the spacer and about 2 ft. below the ground line. However, the plates 38 may also extend along the length of the tube. The connectors 12 protruding within the tube act as shear connectors with the soil matrix within the tube, while the connectors protruding outside the tube provide shear transfer between the tube and the soil matrix outside the tube. The tube 28 has a surface 39 facing the traffic side when installed.

Figure 6:
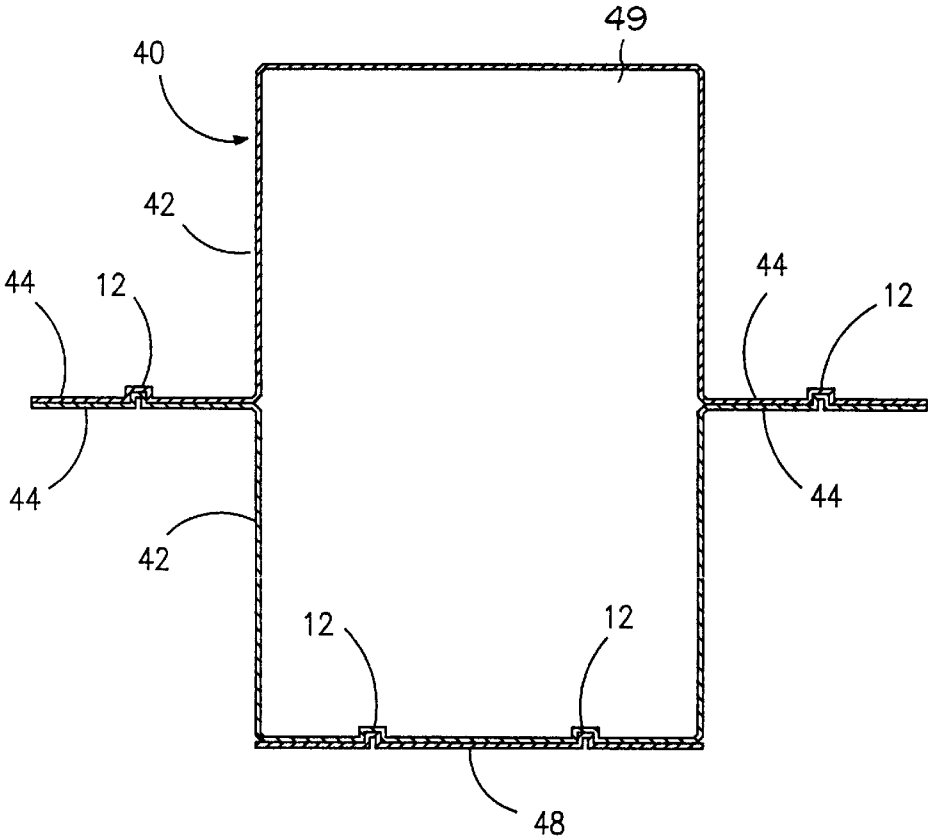

A tube 40 is made from two U-shaped halves 42 with overlapping portions 44 joined together by a plurality of connectors 12, as best shown in FIG. 6. The tube is rectangular in cross-section. A reinforcing plate 48 is secured to one side of the tube by connectors 12. The plate 48 may be installed inside or outside the tube. The plate 48 is preferably shorter than the length of the tube and is secured substantially at the middle portion of the tube, approximately from below the spacer and about 2 ft. below the ground line. However, the plate 48 may also extend along the length of the tube. The tube 40 has a surface 49 facing the traffic side when installed.

Figure 7A:
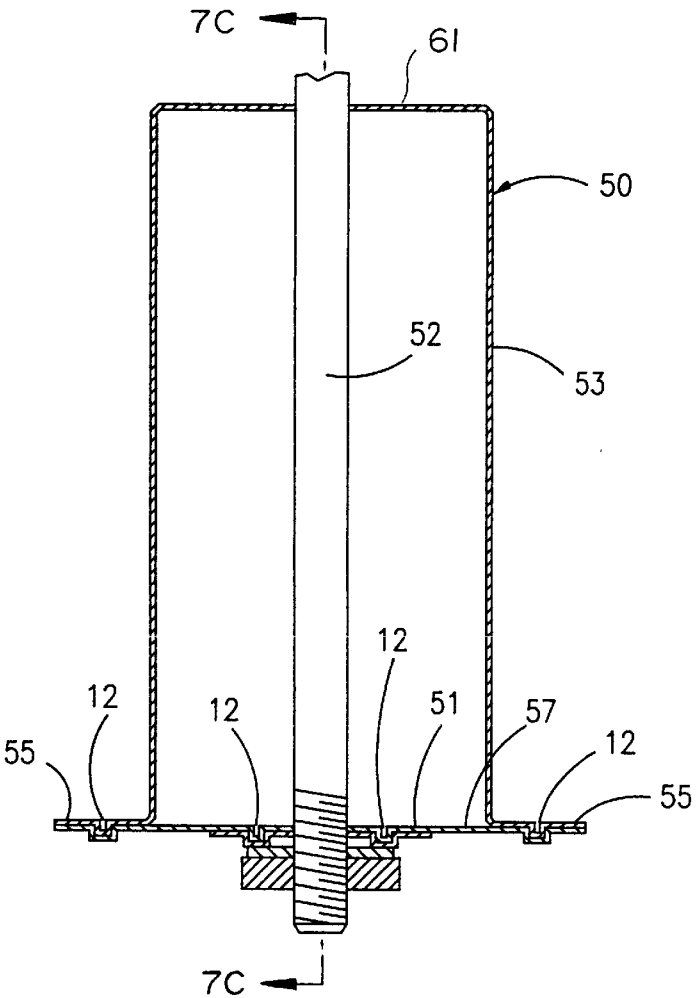
FIG. 7A is a cross-sectional view of a post made in accordance with the present invention, showing a through-bolt through the post used to attach a guardrail.

A tube 50, shown in FIG. 7A, which is similar to the tube 28, is shown with a through-bolt 52 which is used to secure a rail (not shown) to the tube. Sheet metal plate 51 secured by connectors 12 provides reinforcement to the tube. The plate 51 preferably extends from above the bolt hole to about 2 ft. below the ground line, although it may extend to the bottom of the tube. The tube 50 is made from U-shaped sheet metal member 53 joined at overlapping portions with sheet metal plate 57. The member 53 may be shaped such that when joined to the plate 57 will provide a cross-sectional shape to tube 50 which can be rectangular, trapezoidal, trapezium or regular polygon. Further, the individual sides of the tube may be curved, convex or concave. The cross-sectional dimensions may change along the length of tube 50. The tube 50 has a surface 61 that faces the traffic side of the roadway when installed.

Figure 7B:
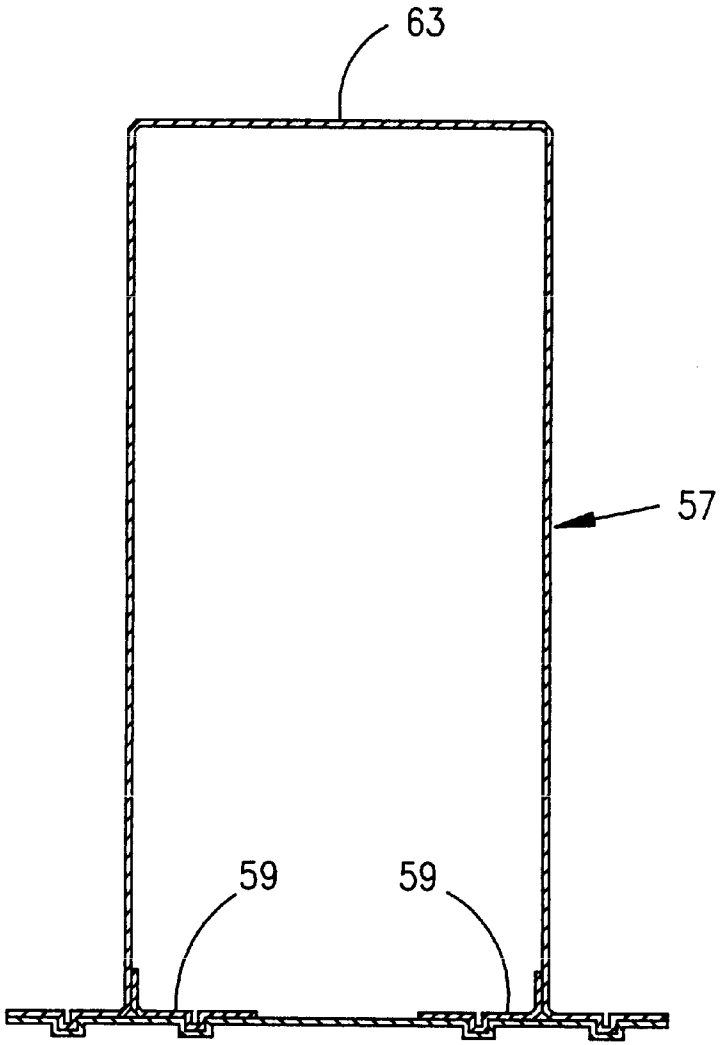
FIG. 7B is a cross-sectional view at the ground line of a post similar to the post of FIG. 7A.

Referring to FIG. 7B, another embodiment of a tube 57 is disclosed, which is similar to the tube 50, except that the plate 51 has been replaced with a pair of angle plates 59 secured with the connectors 12. Surface 63 is the traffic side of the tube when installed.

Figure 7C:
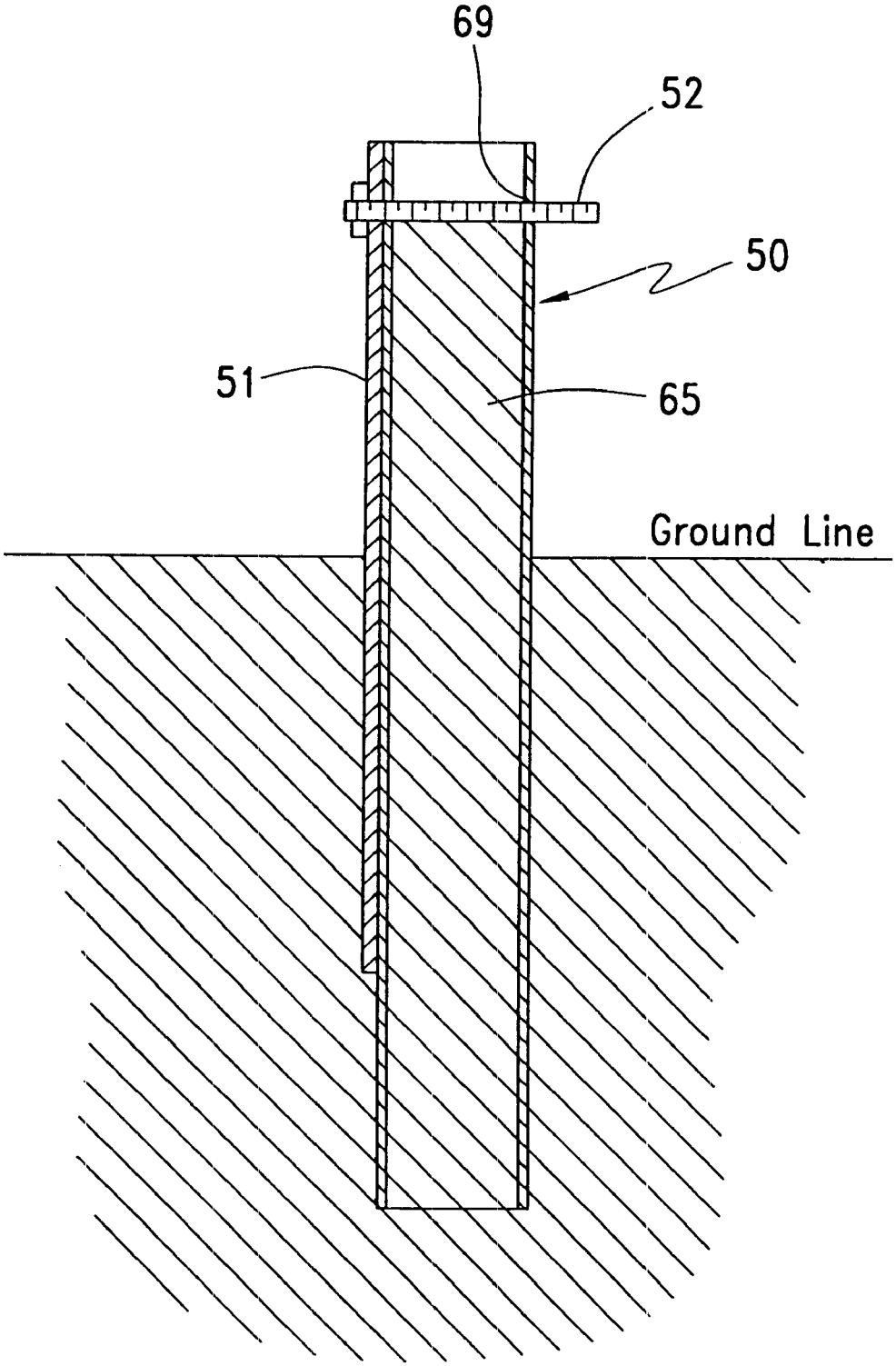
FIG. 7C is a cross-sectional view along line 7C—7C of FIG. 7A.

The various tubes, such as tube 50, may be filled with the soil-matrix 65 in which the tube is disposed to increase the overall structural strength of the tube by providing the shear strength of the soil-matrix to the strength of the tube, as best shown in FIG. 7C. The soil 65 is introduced into the post's interior from the open top, properly tampered in appropriate levels, and brought up to the level of the through-bolt holes 69. The post may also be driven into the soil-matrix. As such, the bottom of the tube may be left open allowing the in-situ soil-matrix to enter from the bottom of the tube. The act of driving an open bottomed tube into the in-situ soil-matrix consolidates and compacts the soil captured both in the tube and the zone immediately in contact with the tube's outer surface. To facilitate the movement and capture of soil into the tube as it is driven, slots or openings may be provided on the sides of the tube. Such slots or openings also provide for drainage of any introduced liquids thereby reducing potential frost-heave due to freeze-thaw action. The captured soil also buttresses the tube wall by reducing the localized-buckling of the tube wall. Filling the tube with soil-matrix also adds mass to the post, creating a structural composite. If a structural foam, or similar material, is enclosed in the tube, with the top of the tube sealed, the act of driving the tube into the ground, and allowing the soil-matrix to travel up the tube, would compress the structural foam and thereby pressurize the tube for greater strength.

The reinforcing plates 38, 48, 51 and 59 may be provided with a structural zone of weakness, such as a cut through the member, to provide an intended manner of failure for the post. Using the tube 40 as an example and referring to FIG. 8, the reinforcing plate 48 is provided with a discontinuity 54 to provide an intended structural zone of weakness. The discontinuity 54 my be disposed at the ground line to cause the post to break at the ground line. The discontinuity 54 is a horizontal cut through the plate 48. Other shapes for the discontinuity may be used, such as a U-shaped discontinuity 56 shown in FIG. 9, or V-shaped discontinuity 58 shown in FIG. 10. These various discontinuities have differing structural properties useful for different applications. Note the connectors 12 are spaced along the length of the tube.

Figure 11:
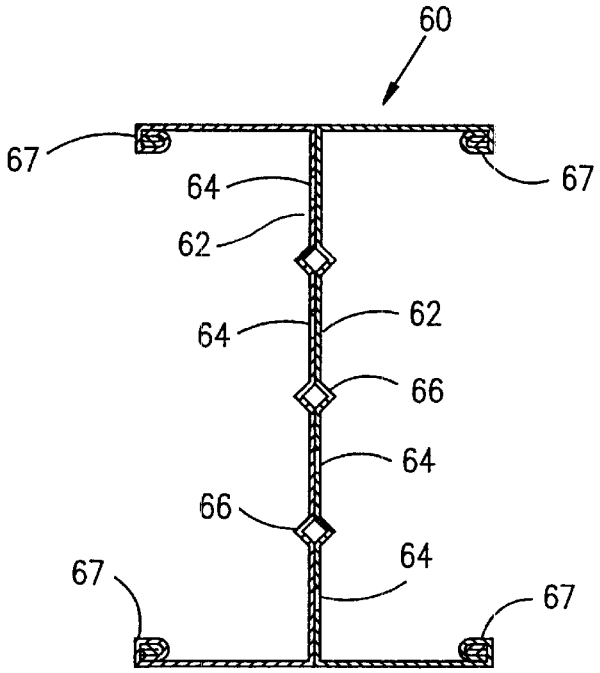
FIG. 11 is a cross-sectional view of another embodiment of a post made from sheet metal in accordance with the present invention.

Referring to FIG. 11, a post 60 comprises a pair of U-channel sheet metal members 62 joined together back-to-back to form an overall wide-flange beam cross-section. Each member 62 has a plurality of holes 64 extending longitudinally along the length of the member for use in spot welding one member to the other member. Alternately, standard connectors may be used to join members 62 together. Rolled ribs 66 are provided for each member for rigidity. Flange edges 67 are folded for strength, as will be described below.

Figure 12A:
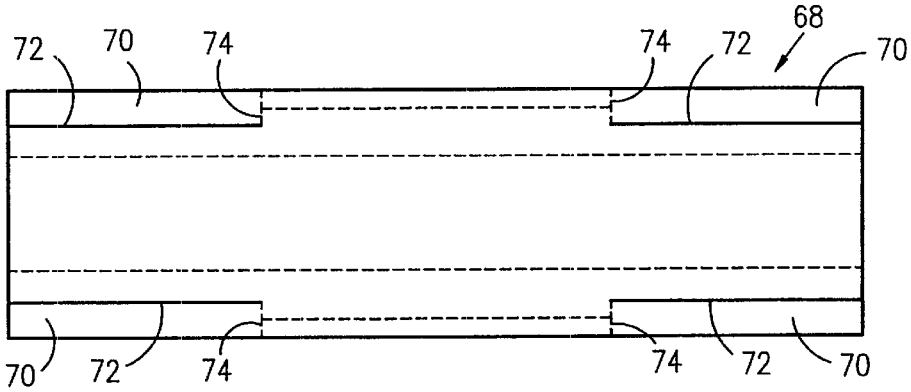
FIGS. 12A–12I show the various folding steps used to make a U-channel sheet metal member for making the post of FIG. 11.
Figure 12B:
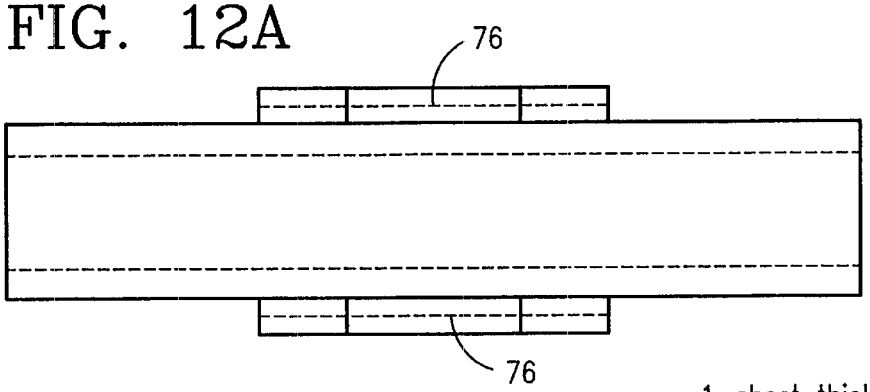
Figure 12C:
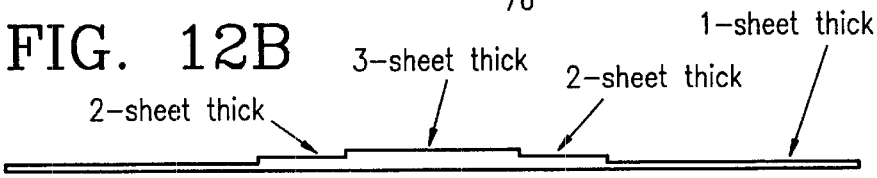
Figure 12D:
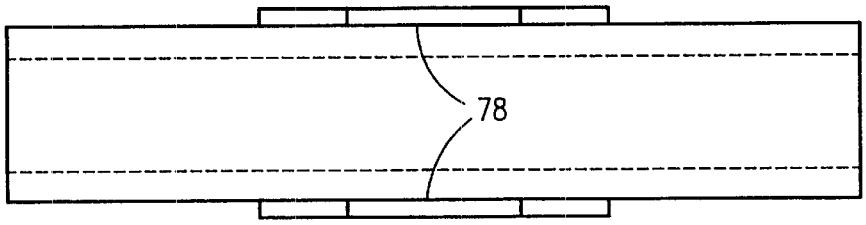
Figure 12E:
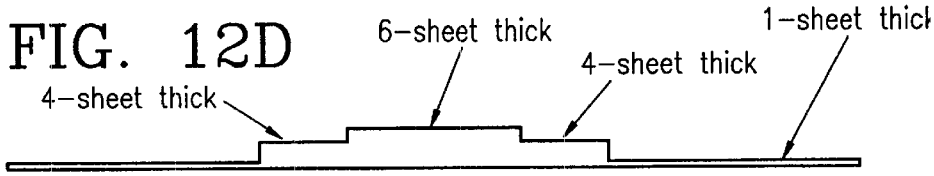
Figure 12F:
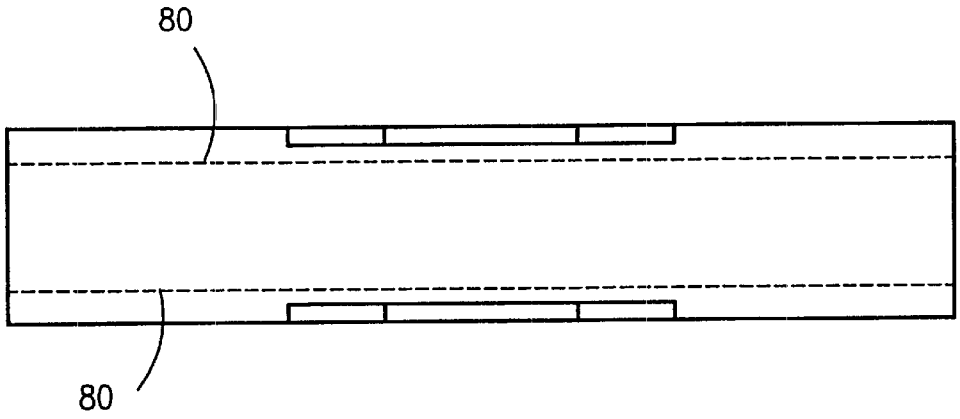
Figure 12G:
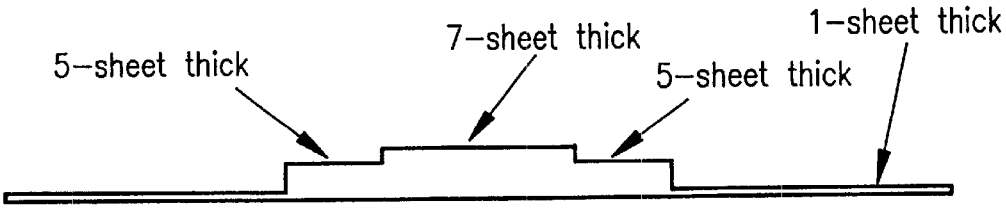
Figure 12H:
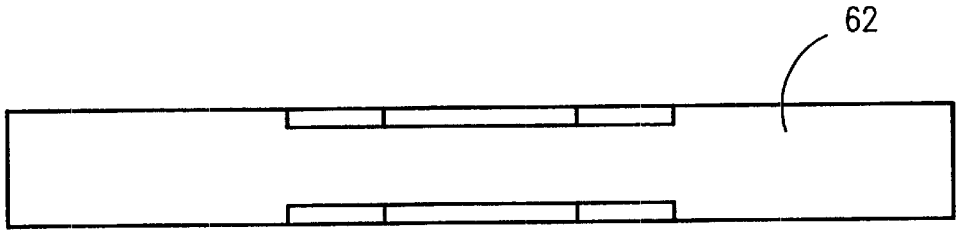
Figure 12I:
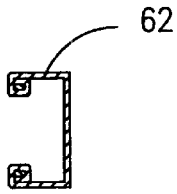

Referring to FIGS. 12A–12I, the U-channel member 62 is formed from sheet metal blank 68. Edge tabs 70 are cut along lines 72 and folded 180° along lines 74 to obtain a configuration shown in FIG. 122. Three-sheet thick middle portions and two-sheet thick end portions result from the folding operation, as shown in FIG. 12C. The folded edge tabs are folded 180° along lines 76 to form a configuration shown in FIG. 12D, resulting in six-sheet thick middle portions and four-sheet thick end portions, as shown in FIG. 12E. The folded edge tabs are then folded 180° along line 78 to form a configuration shown in FIG. 12F. The middle portion of each edge tab is now seven-sheet thick and the corresponding end portions are five-sheet thick, as shown in FIG. 12G. The blank 68 is then folded 90° along lines 80 to form the U-channel member 62, as best shown in FIGS. 12H and 12I. Where appropriate, standard connectors may be used to join one or more folds and/or tabs.

Another embodiment of the U-channel sheet metal member 62 is formed from a sheet metal blank 82 through a series of folding operations, as shown in FIGS. 13A–13J.

Figure 13A:
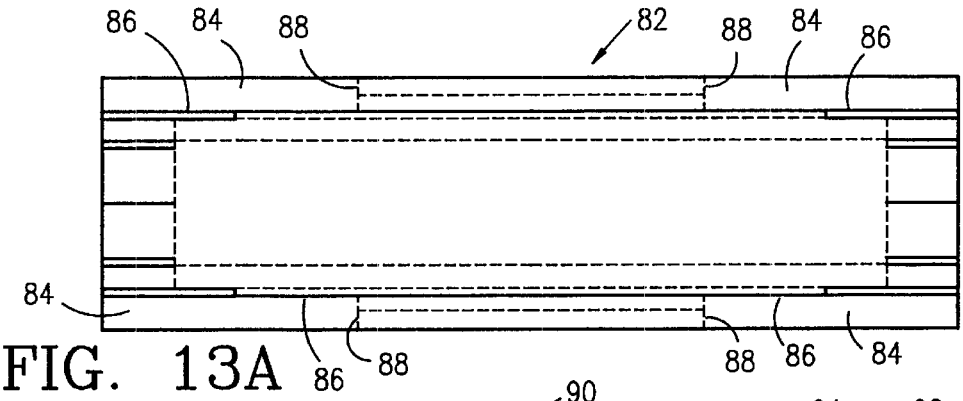
FIGS. 13A–13J show the various steps in folding a blank sheet metal to make another embodiment of a U-channel sheet metal member.
Figure 13B:
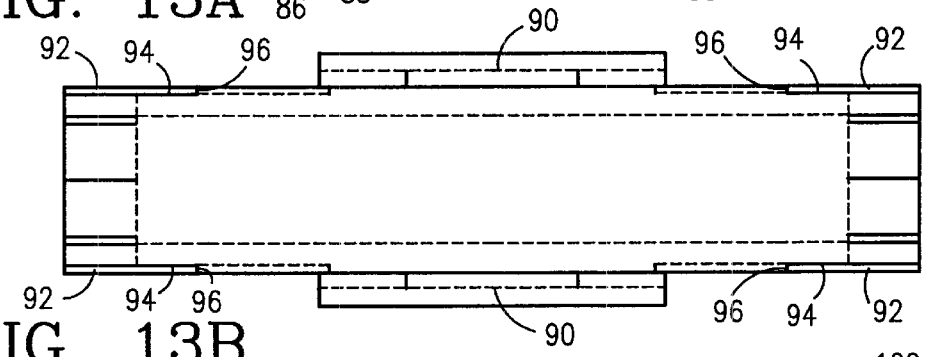
Figure 13C:
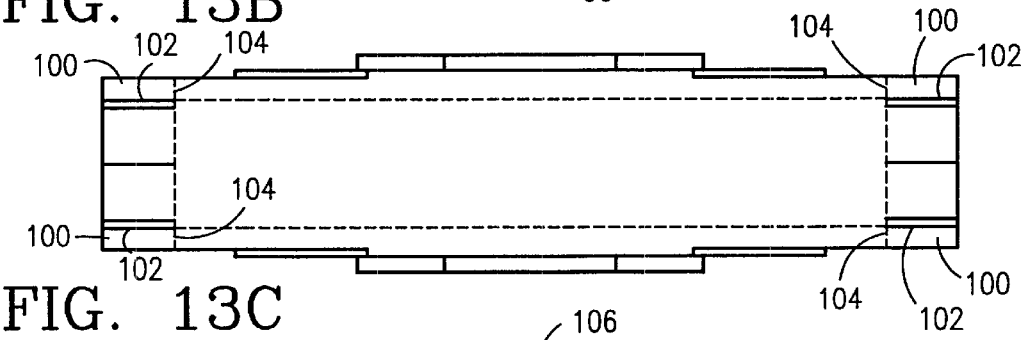
Figure 13D:
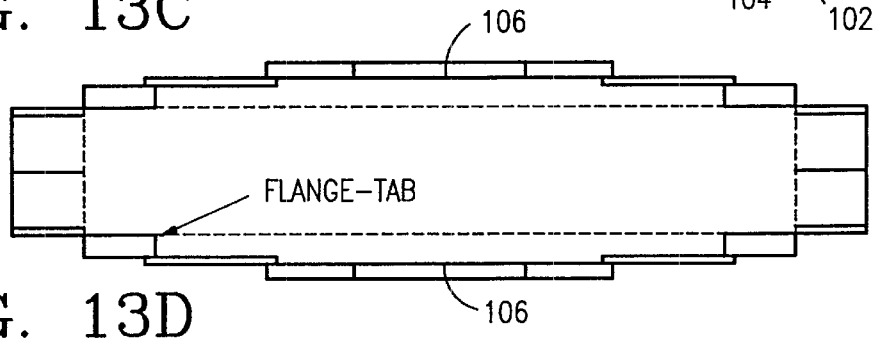
Figure 13E:
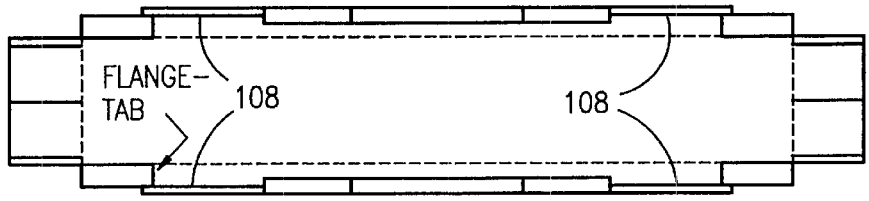
Figure 13F:
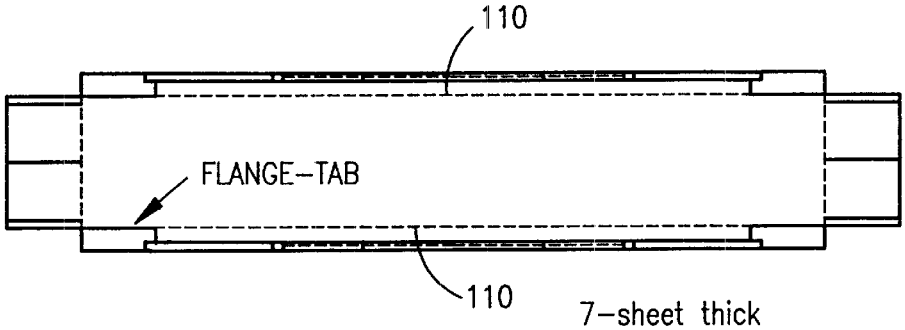
Figure 13G:
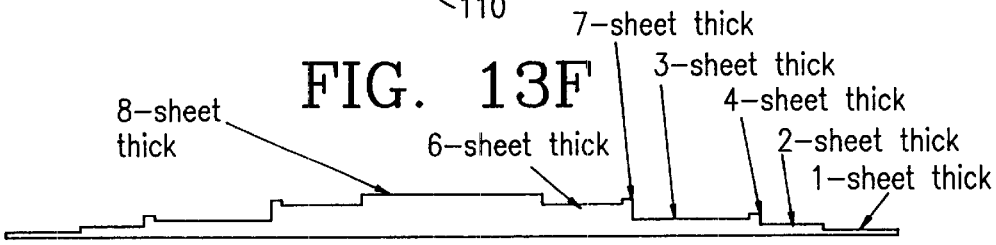
Figure 13H:
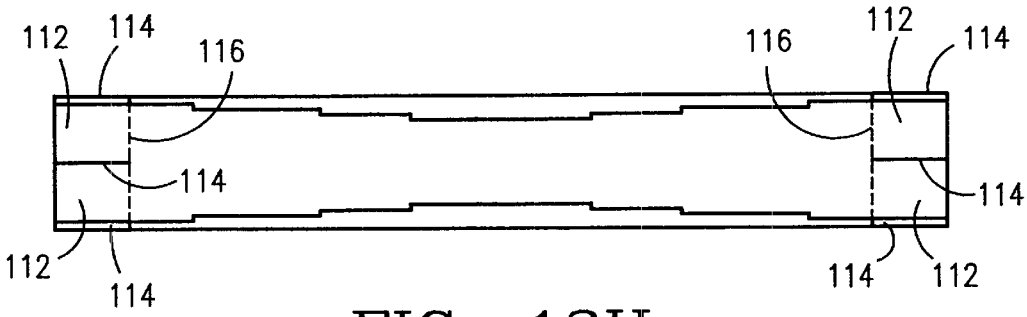
Figure 13I:
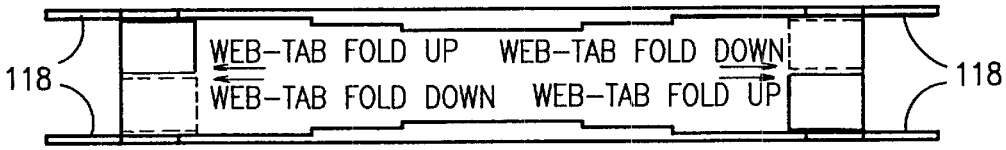
Figure 13J:
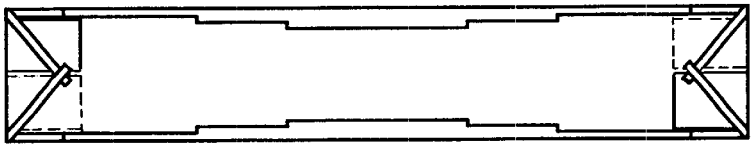

The sheet metal blank 82 has edge tabs 84 cut along lines 86 and folded 180° along lines 88 to form a configuration shown in FIG. 13B. The folded edge tabs are then folded 180° along lines 90 to form the configuration shown in FIG. 13C. Flange tabs 92 are cut along lines 94 and folded 180° along lines 96 to form the configuration shown in FIG. 13C. Flange edge tabs 100 are cut along lines 102 and folded 180° along lines 104 to form the configuration shown in FIG. 13D. The folded edge tabs are then folded 180° along lines 106 to form a configuration shown in FIG. 13E. The folded edge tabs and the folded flange edge tabs are folded 180° along lines 108 to form the configuration shown in FIG. 13F. The folded portions of the sheet metal blank 82 will have several sheets thicknesses, with the middle portions being the thickest, as best shown in FIG. 13G. The folded edge tabs, the folded flange edge tabs and the folded flange tabs are then folded 90° along lines 110 to form a configuration shown in FIG. 13H, having a U-shaped cross sectional shape. Web tabs 112 are cut along lines 114 and folded 180° along lines 116 to form a configuration shown in FIG. 13I. The web tabs 112 are folded in opposite directions relative to the adjacent ones. Corner tabs 118 are then folded 180° in a crisscross fashion, as best shown in FIG. 13J. The corner tabs 118 are spot welded after being folded. Where appropriate, standard connectors may be used to join one or more folds and/or tabs.

Sheet metal flange plates 120 may be secured to the respective U-channel member legs for greater strength. U-channel members 124 may be nested within the middle portions of the respective U-channel members 62 for additional load capabilities. The legs of the U-channel members 124 may be bent so as to form a triangle 126 when nested within the respective U-channel members 62, as best shown in FIGS. 15A and 15B.

Figure 16:
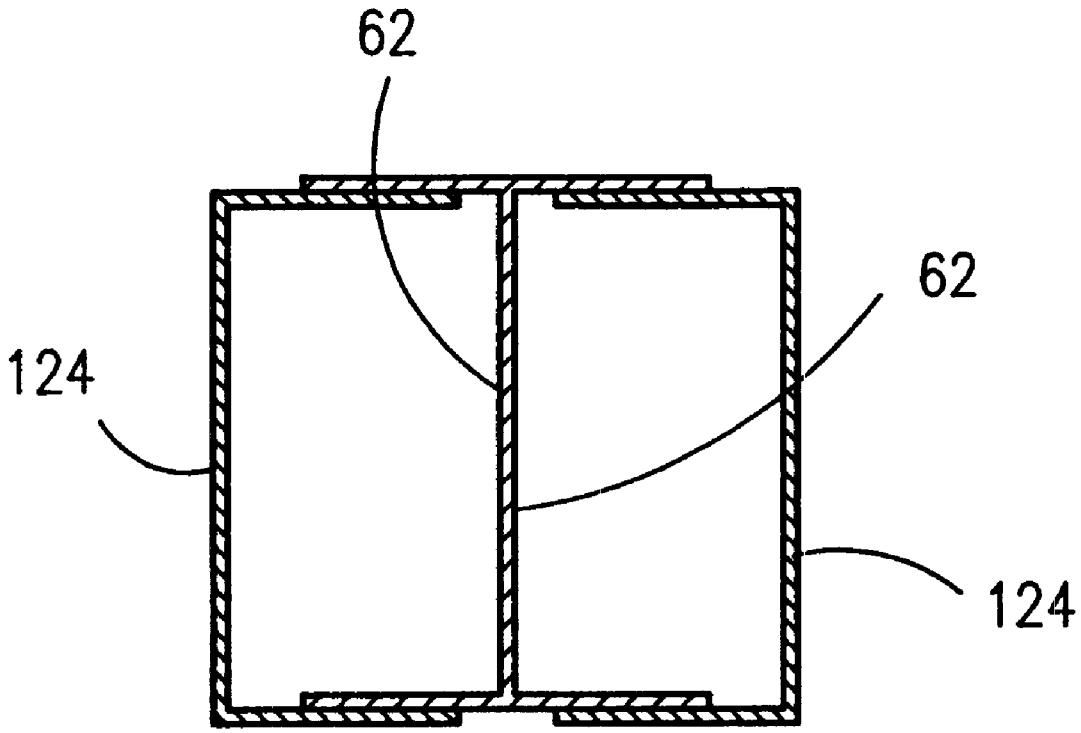
FIG. 16 is a cross-sectional view of the post of FIG. 11, showing U-channel reinforcement members forming a box structure with the post.

The U-channel members 124 may be secured to the respective U-channel member 62 so as to form a tubular cross-section, as best shown in FIG. 16. Alternatively, the U-channel members 124 may extend along the entire length of the member 62 to form a closed section. Standard connectors may be used to join the members 124 to the member 62. Member 62 in FIG. 16 may be constructed as in FIG. 11, or may be a preformed shape such as a hot-rolled wide flange section.

Although sheet metal is preferred for the post 60, other suitable sheet materials may be used, such as plastic, fiberglass, etc., or combinations thereof.

The various posts of the present invention would provide the same function as the prior art strong-post design, providing for little deflection in resisting impacting vehicles in a rigid-manner, while using significantly less material.

Laterally loaded shallow foundation piles, such as guardrail posts, permanent retaining walls, permanent sea walls, permanent and/or temporary trench walls, underground support structures, and similar structural system components tend to be designed as cantilevers. That is, one end of the post is considered structurally fixed and the other end is structurally not-fixed or free-to-rotate or deflect-under-load; or the not-fixed end is allowed to deflect when under design loadings. In the case of strong-post guardrail system, the design load is usually point-load applied via the W-beam rail component thru the spacer-block to the not-fixed end (in normal guardrail applications the not-fixed end is the top of the post). The face of the post facing toward the loadings tend to be in tension when under design loads. The opposite face of the post tends to be in compression when design loads are applied. To maintain structural integrity, the post must transfer shear loads between opposing faces (tensile/compressive) without significant change in distance between the faces.

The posts of the present invention would also be suitable for installation by the drop-hammer or pile-driving method, as is used with prior art W6×8.5 wide-flange steel posts, while using significantly less material. The typical truck-mounted guardrail post-driver is a gravity-dead-weight which is dropped on the top of an individual post, driving the post into the in-situ soil-matrix. The post is driven by successive blows of the drop-weight to the depth desired. Unlike typical foundation pile driving, the guardrail post must be driven to a specific depth as the W-beam rail component must, by government regulations, be at a specific height above the usually nearby road surface.

The posts of the present invention have sufficient hardness at its foot to cut through the soil matrix (and/or other foundation materials such as asphalt) that the posts are driven into without significant physical deformation. In addition, the post's top has structural integrity to withstand the driving operation of placing the post to the appropriate depth into the soil matrix and to fully develop the load transfer from the highway guardrail systems's spacer-block. The top of the post may be specifically reinforced across, and/or around the post top and/or the reinforcement extended down the sides of the post.

The posts of the present invention further provides for equal or greater spade interaction with the standard soil-matrixes compared to the prior art. Note the overlapping portions 10, 18, 24, 34, 44 and 55 in FIGS. 2–7 provide the increased spade width to fully develop the lateral load capacity of the soil matrix. The post of the present invention provides material economy since the post provides the in-situ soil a broader, more spade-width face, thereby permitting the use of a shorter length post. Providing a fabricated steel post with a wood-post-like broader face on the compressive flange allows for either more load-bearing before soil foundation shear-failure or more material in the critical compression localized-buckling region of the post (thereby providing for more load capacity) or both.

Failure of the soil matrix to resist the design lateral loadings is usually a result of either inferior soil conditions for the design loads in question, or failure of the post's compressive face to fully develop the strength of the soil matrix due to less than optimal spade dimensionality aspects of the post's width or face against the in-situ soil matrix in question. (Failure of the soil matrix in contact with the post's tensile face should be considered but is usually rare in short piles, such as guardrail posts, as the soil-matrix in question tends to be more structurally strong as one approaches the roadway bedding).

A strong-post guardrail post in some cases of dynamic service loadings is preferable to break off at the ground line so as not to present additional risks to the impacting vehicle. For example, when torque is applied to the guardrail post via the post-bolt by an impacting vehicle deflecting the rail component beyond its original vertical plane, or when an impacting vehicle strikes with such force as to lay-back (or the foundation soil-matrix shears) the guardrail posts, or when an impacting vehicle attempts to climb-over or squeeze-under the rail component as an impacting vehicle deflects the rail component beyond its original horizontal plane, it is sometimes preferable for the post to break so that the impacting vehicle would not snag on the exposed base of the posts.

Figure 8:
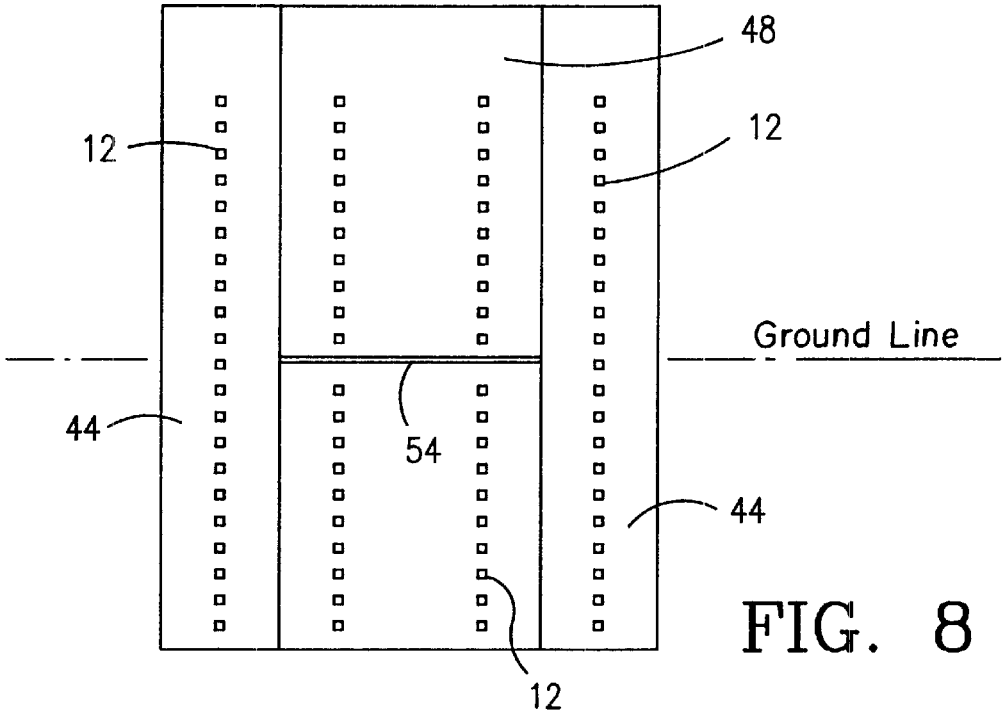
FIGS. 8, 9 and 10 are side elevational views of FIG. 6 showing various embodiments of a cut in the reinforcement plate to provide an intended structural zone of weakness in the post.

One means for addressing how a post's structural failure can be pre-designed into the structural element's nature is through the use of placing a discontinuity in the material. As shown in FIG. 8, the discontinuity 54 can be used to provide for a difference in a post elements's structural capacity in tension versus compression. An application would be where the structural system's designer wishes to resist in one direction a lateral load on a post element but wishes to have the post provide less resistance from a lateral load applied from a different direction. In a post subjected to a torsion case-load, the discontinuity 54 would provide for a post failure in shear across the discontinuity. If the post's discontinuity was located at or near the ground-line then the post could be designed to fail in torsion, breakaway, and remove itself from potentially snagging an impacting vehicle. The plates above and below the discontinuity 54 could be firmly in contact with each other so as to transfer loads when under compression.

Figure 9:
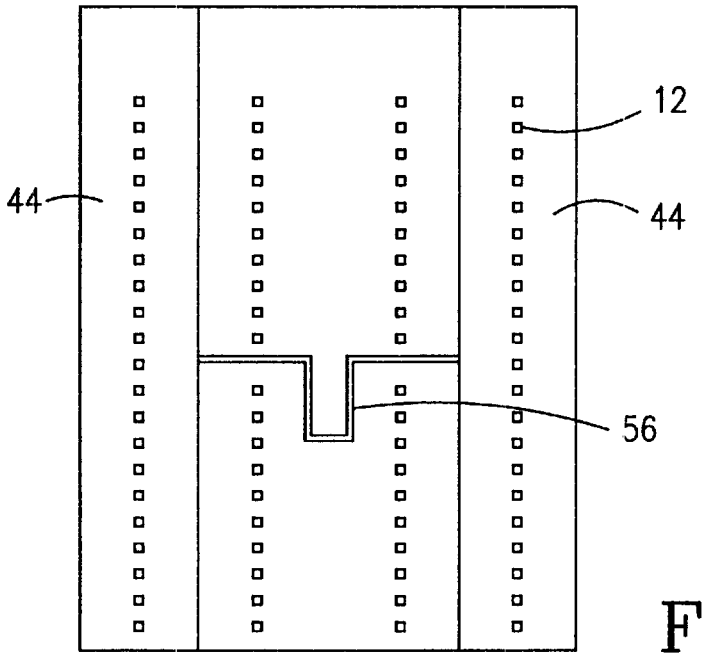

Referring to FIG. 9, the discontinuity 56 provides for both compressive and torsional resistance but is intended to weak when subjected to tensile loads.

Figure 10:
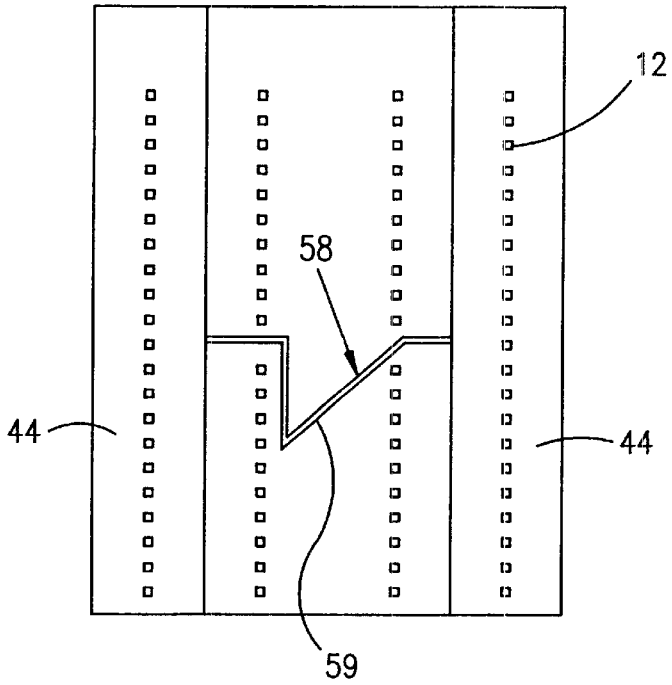

The discontinuity 58 shown in FIG. 10 provides selective torsion resistance properties. For example, a clockwise applied torsional load would be resisted by the post's discontinuity, if the plate edges forming the discontinuity were firmly in contact with each other but in a counter-clockwise applied torsional loading, if an intensional gap was provided on the diagonal region 59 of the discontinuity, the post would be less structurally strong in resisting the applied counter-clockwise torsional loading.

The post of the present invention may be used with standard spacers and rails, or with the spacers and rails made in accordance with the present invention as described below.

SPACER

Figure 17:
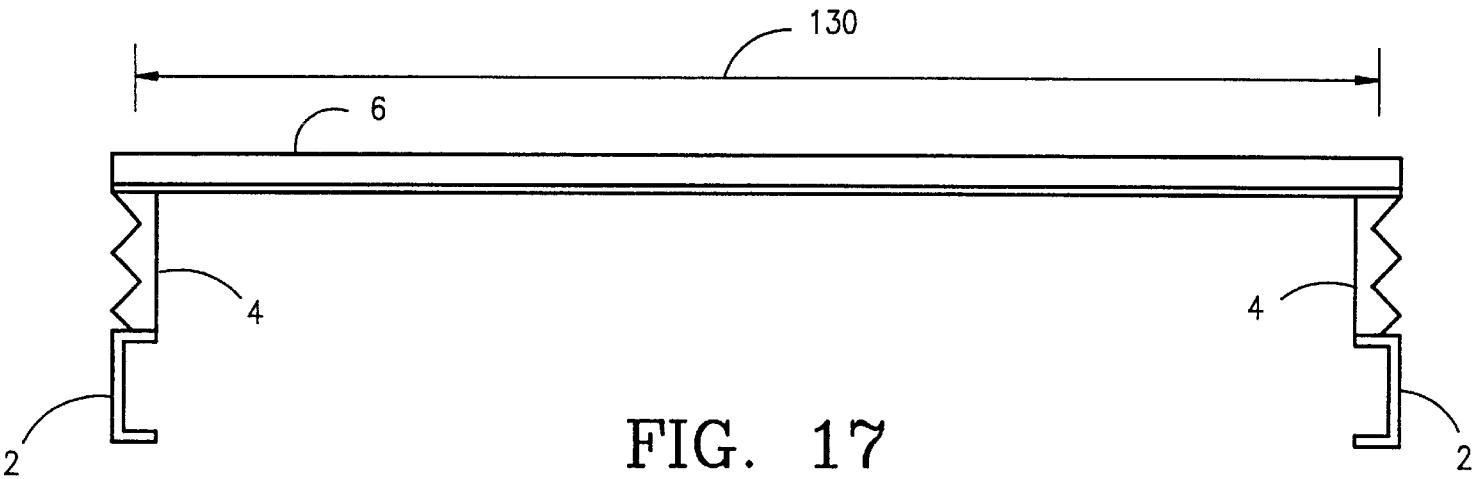
FIG. 17 is a schematic top plan view of a standard guardrail system.

A standard guardrail system is disclosed in FIG. 17, as viewed from the top. The posts 2 are typically spaced at approximately 12.5 feet or 6.25 feet apart. The standard spacer blocks 4 support the guardrail 6 at the free span or unsupported go length equal to the spacing of the posts 2. The rail 6 is a standard W-beam of sufficient gauge.

Figure 18:
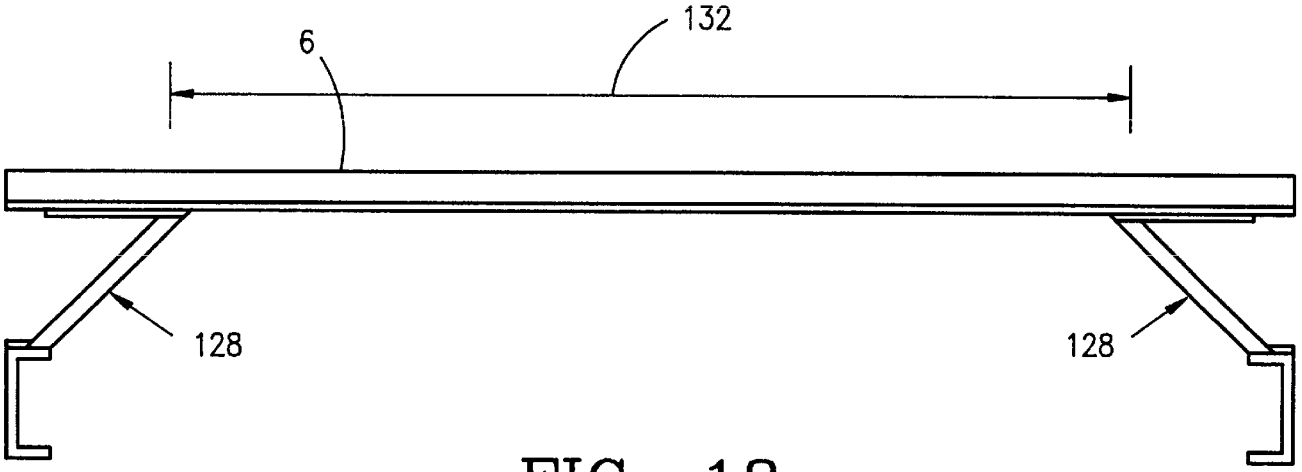
FIG. 18 is a schematic top plan view of a guardrail system using a spacer made in accordance with the present invention.

Referring to FIGS. 17 and 18, distance 130 between adjacent conventional spacer blocks is larger between the distance 132 between two spacer blocks 128 made in accordance with the present invention. The decreased distance advantageously permits the use of lesser material for the rails.

The spacer 128 is formed from sheet metal into a substantially "7"-shaped form or its mirror image. Each post will have a pair of spacers 128, each one being a mirror image of the other.

Figure 19:
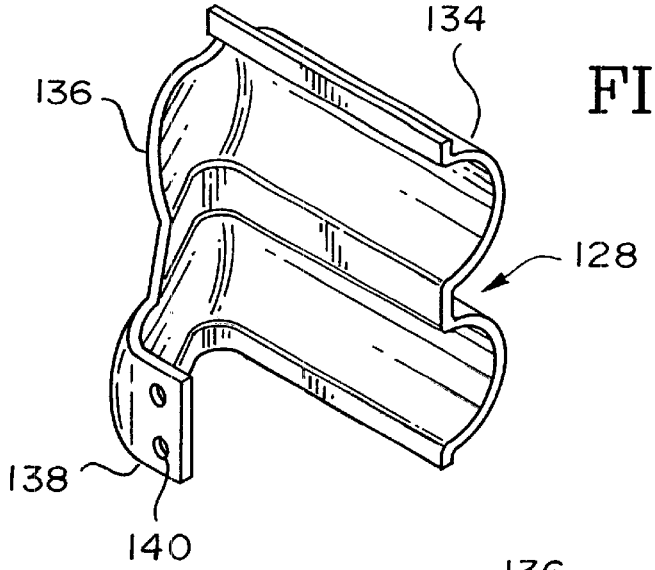
FIG. 19 is a perspective view of a spacer made in accordance with the present invention.
Figure 20:
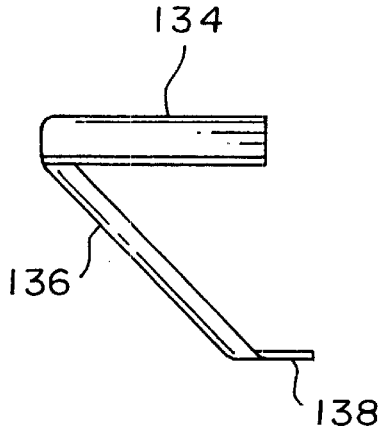
FIG. 20 is a top plan view of FIG. 19.
Figure 21:
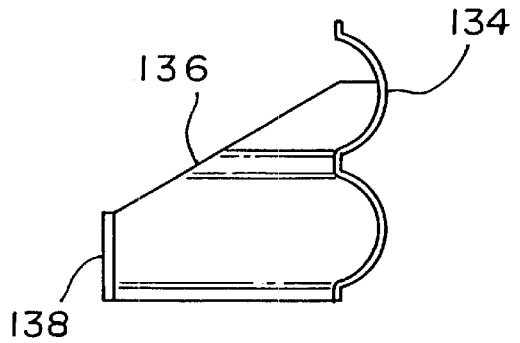
FIG. 21 is a right side elevation of FIG. 19.

Referring to FIGS. 19, 20 and 21, there is disclosed a left hand spacer 128, having a rail attachment portions 134, a bridge portion 136 and a post attachment portion 138. The rail attachment portion 134 has a cross-section shape adapted to nest into a standard W-rail. The bridge portion 136 also has a W-cross section for rigidity. The post attachment portion 138 includes holes 140 for receiving the through-bolts for attachment to the post.

Figure 24:
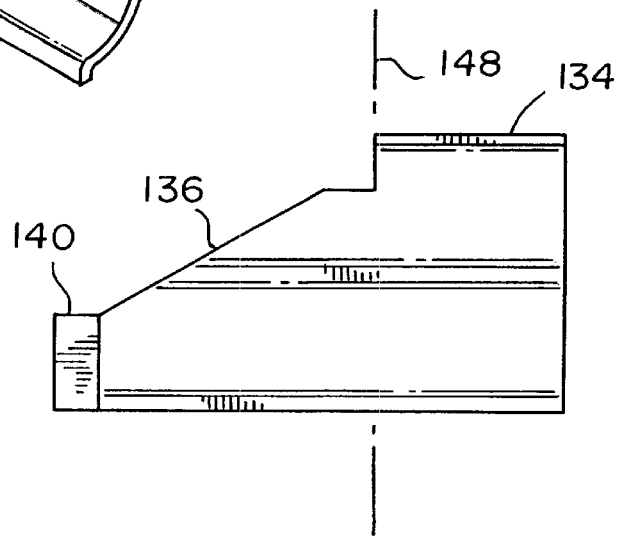
FIG. 24 is a plan view of one of the pieces of FIG. 23 after having been stamped with corrugations.
Figure 22:
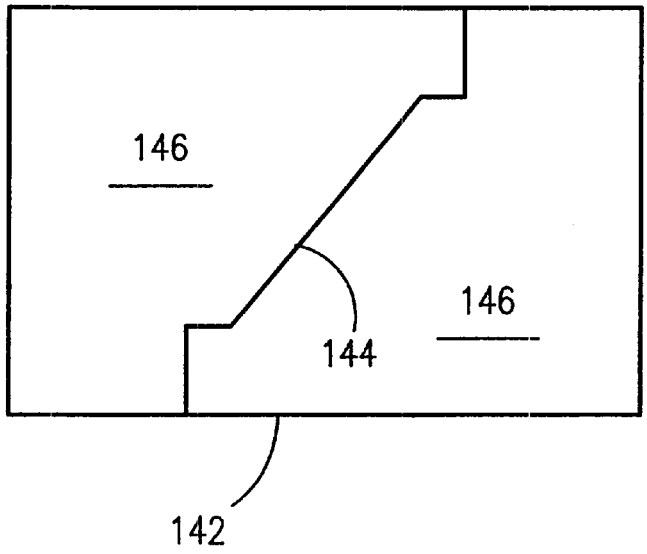
FIG. 22 is a blank sheet metal used to make the spacer of FIG. 19.
Figure 23:
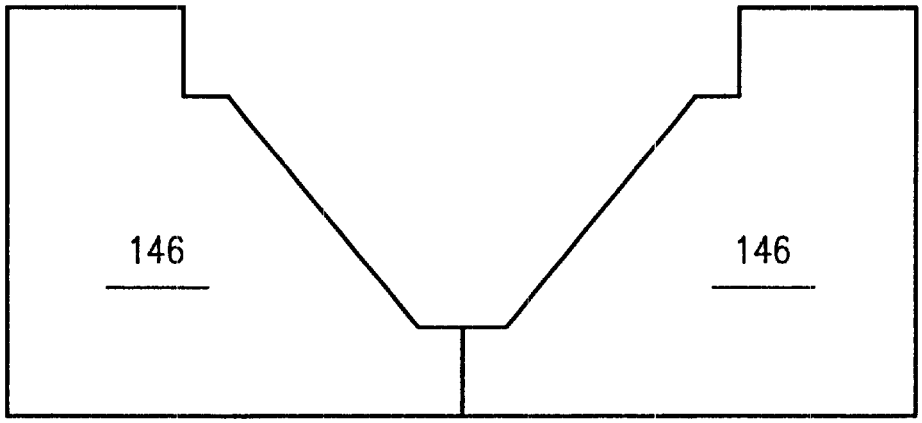
FIG. 23 is the blank sheet metal of FIG. 22 after being cut to identical pieces.

The left and right hand spacers 128 are formed from a rectangular sheet metal blank 142, as best shown in FIG. 22. The blank 142 is cut along a series of interconnected lines 144 to obtain two identical pieces 146, as best shown in FIGS. 22 and 23. Each piece 146 is then stamped into substantially W-cross sectional shape, as best shown in FIG. 24. The pressing process is similar to that used to make the standard W-beam system's end-shoe where the end of the sheet remains flat but the rest of the sheet is corrugated. After the corrugation, the post attachment portion 140 is bent and then a distance in from the opposite-side the corrugated section is rolled or break-formed along line 148 to a sharp angle to form the 7-shaped or its mirror image. The post attachment portion 138 is approximately parallel with the rail attachment portion 134 in the case of the guardrail application for longitudinal crash barriers. The spacer's other two sides make acute-angles from the rail component as they travel from the rail component on the traffic-side face or attached to the top of the post component.

Referring to FIGS. 25 and 26, the spacers 128 are secured to the post 60 by through-bolts 151. Standard post 2 may also be used. The ends of two rail 6 are overlap at 150 and are secured with bolts 152. The rail attachment portions 134 are secured to the overlapping end portions of the rails.

Referring to FIG. 26, it will be seen that the top portions of the rail 6 is some distance above the top edge of the post 2 to advantageously prevent a car riding along the rail from snagging the post 2. The design of the spacer 128 is such that the rail 6 is raised in relation to the top edge of the post 2.

The spacer 128 of the present invention concentrates the great lateral thrusts of impacting vehicles of the highway guardrail W-beam component and via moment-resistance begins the structural process of transferring the lateral loadings to the foundation soil-matrix by way of the post component.

The spacer 128 provides several attributes. There is an overall reduction in the required guardrail post length by a recognition that the section-modulus requirements can be carried by the spacer itself, as the structural requirements are significantly less than at ground-line.

The spacer 128 reduces the free-span distance on the rail component. For example, on the prior art 6'-3" post spacing guardrail layout, the prior art free-span of 5'-9" is reduced to 4'-5". This significant reduction in unsupported-length allows for reductions in the dimensionality of the W-beam, such as the gauge thickness and/or depth of corrugations and/or other attributes such as strength-of-materials issues.

The spacer 128 is completely masked from impacting vehicles by the W-beam rail component. That is, unlike the prior art spacer-block which is required to extend an inch above and below the W-beam rail component, (the standard W-beam rail component having a projected 12" face and the standard block being 14") the spacer 128 does not present a potential snag for an impacting vehicle body components as it rides-the-rail.

The spacer 128 acts as a backing-plate sandwiching the overlay region of the standard W-beam splice-bolt-pattern area. Assuming proper torque on the standard W-beam splice-bolts in question, the sandwich made by the two overlapping layers of the standard W-beam and the third layer of the spacer 128 nested behind, puts the splice-bolts into double-shear which allows the bolts to be stronger systems-wise. Further, the spacer 128 also adds resistance to the bolts tendency to rotate or develop prying-action on the standard W-beam when the rail system is significantly deformed structurally due to deep penetration of the impacting vehicle in the space between posts. Rotation of the standard W-beam due to the aforementioned impacting vehicle results in the down-stream splice-bolts prying against and then ripping through the unsupported away-from-traffic side on the down-stream standard W-beam rail section. That is, the prying splice-bolts pry against the spacer 128 material and not directly against the standard W-beam rail section. Still further, once the splice-bolts are properly torqued, the plate-action of the three layers of steel provide structural strength to bridge the splice-bolt-holes and allow the full cross-sectional area of the standard W-beam to carry the loads. That is, the splice-bolt-bole cross-sectional area of the standard W-beam is less influential to ultimate-load-carrying capacity of the standard W-beam rail component due to the friction developed by the sandwiched steel plates.

The spacer is designed to keep and maintain the design distance between the post component and the rail component for the design loads intended. When loadings in excess of design loads are encountered, the spacer would structurally fail only after a structural failure of the post. The spacer would structurally maintain its physical location between the post component so as to continue its mission as spacer and maintain its shape. This is frequently not the case where wood spacer blocks are used. That is, when standard, presently acceptable wood-spacer-blocks are used and subjected to loadings in excess of anticipated design loads, the wood block shears and/or breaks into smaller pieces and are usually ejected from the highway guardrail's structural system. Once the wood block is eliminated, the rail component is no longer held away from the post component and the impacting vehicle tends to snag on both the thru-bolt and the post component. However, in cases of significant lateral loadings greater than design loads, the spacer should structurally fail once its companion post element has deformed and/or displaced and has assumed a bent-back position and in the proximity of the ground-line. That is, to avoid having the spacer become the cause of vehicle snagging, once the structural failure of the post element is substantially complete, the spacer is designed to structurally fail such that it separates from the rail element and/or the post element. It is desirable that in addition to the aforementioned structural separation that the spacer easily deform if, after post failure, the spacer comes in contact with an impacting vehicle. If spacer separation does not occur easily, the vertical aspect or height of the rail element may be reduced resulting in a greater probably of the impacting vehicle rolling over the rail.

The spacer is also designed to provide torsion-resistance by structurally transferring loads to the next post component in line. That is, an impacting vehicle tends to pocket the structural system of a line of highway guardrail. This pocketing draws the rail component toward the impacting vehicle. The rail component in turn pulls the spacer block with it which results in the spacer-block applying torsion to the post component. If the spacer is sufficiently stiff and maintains good structural integrity with both the rail and post components then the spacer's rotation will develop additional tension in the next rail component and thereby transfer loads to the next post in the line. This results in the favorable condition of keeping the pocket shallower than otherwise.

The spacer is further designed to provide help in keeping the rail component splice region in-plane, that is, when an impacting vehicle creates a large pocket in a line of guardrail and the pocket's leading-edge, as the impacting vehicle plows along the line of guardrail, encounters a splice where one rail component is attached to the next rail component, there is a tendency for the rail to bend just in front of, at, or just after the last line of splice bolts. The bending occurs in this region of the rail structural sub-system of the guardrail's overall structural system because the rail components are over-lapped and in the over-lap splice region the rail is significantly stiffer than just after the line of splice bolts farthest from the impacting vehicle on the leading edge of the pocket. The spacer provides additional stiffness to the rail beyond this last line of splice-bolts.

The structural behavior of the individual W-beam section is influenced by the structural connection joint between the W-beam and the spacer-block component. There are two dis-similar structural joint connections in the prior art W-beam strong-post guardrail system. The first structural joint is a moment-resistance lap-splice joint where two individual W-beam sections are connected. This overlapping adds significant stiffness to this location. The structural connection to the spacer-block and post components is made by way of a carriage-bolt or post-bolt which passes thru the lap-splice then through the spacer-block and finally through the traffic-side of the post. The second structural joint is a pin-connection-type at spacer-block-and-post locations between rail splice locations.

The standard, prior art W-beam rail component is pierced with an eight individual splice bolt hole pattern at the lap-splice. The W-beam rail is also pieced in the valley between the corrugations to accommodate the post-bolt. The cross-sectional area reduction of the W-beam by the splice-bolt hole pattern makes this location the structural weak-point in the rail component structural sub-system of the guardrail system. Shear-tear failure frequently occurs in this region of the W-beam. Failure usually occurs when an impacting vehicle deflects the guardrail line resulting in application of torque to the nearby posts, thru the post-bolt connection. As the posts rotate toward the point of largest deflection off the original line, of the moving"pocket" created by the impacting vehicle as it rides the line of rail the down-stream W-beam lap-splice's farther line of splice-bolts.are put into prying-action. The present invention's spacer is designed to mitigate this prying-action source of potential structural failure.

At those intermediate locations where the W-beam is attached to a block and post not at a lap-splice, the post-bolt is the only fastener present. The connection is significantly less moment-resistant as the block's width and post-bolt is the only resistance to the rail rotating around the connection. The present invention's spacer additional width provides greater rotational resistance. Another spacer configuration is used for short sections of the present invention's post elements. Where some snagging is not considered critical, the spacer can be extended out, in the direction of potential impacting vehicles, above and below the rail element, thereby providing additional stiffness or resistance to the rail element from flattening out when impacted.

The spacer 128 may be used with standard posts and rails, or with the posts and rails made in accordance with the present invention as described above and below.

RAIL

Figure 27:
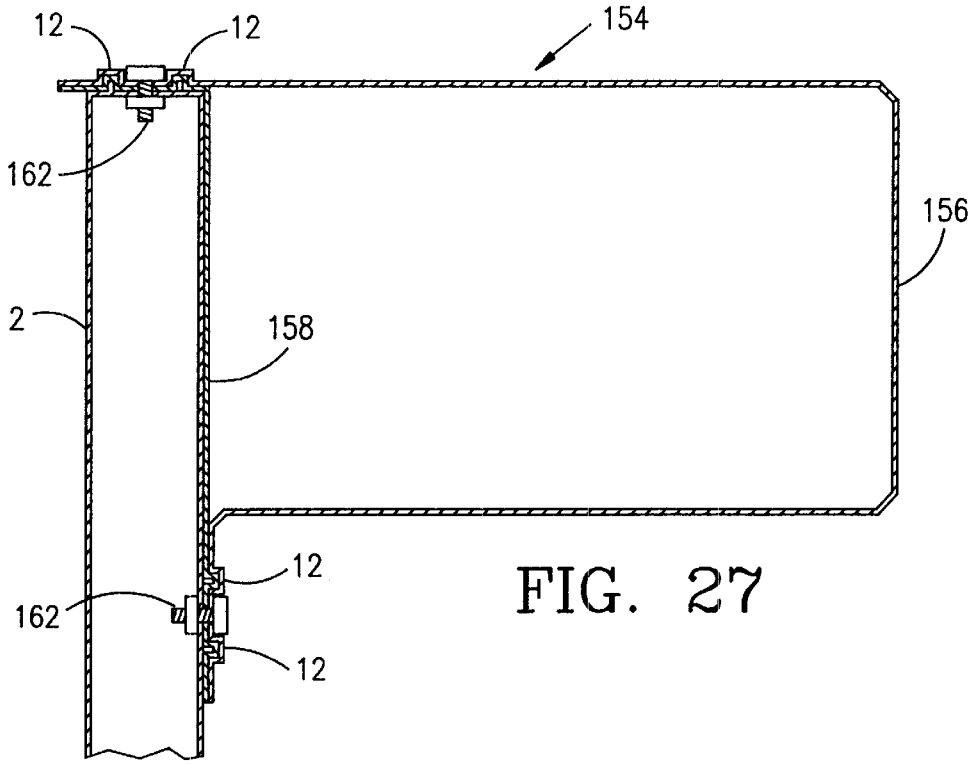
FIG. 27 is a cross-sectional view through an embodiment of a rail made in accordance with the present invention.

Referring to FIG. 27, a rail 154 made in accordance with the present invention is disclosed. The rail 154 is made from sheet metal formed into a tube from a U-shaped cross-sectional member 156 and a sheet metal plate member 158 joined together by connectors 12 providing a rectangular, trapezoidal, trapezium or regular polygon cross-sectional shape. The plate member 158 is substantially L-shaped. Individual sides may be curved, convex or concave. The cross-sectional dimensions may change along the length of tube. The rail 154 is secured to the post 2 by means of bolts 162 disposed between rows of connectors 12.

Figure 28:
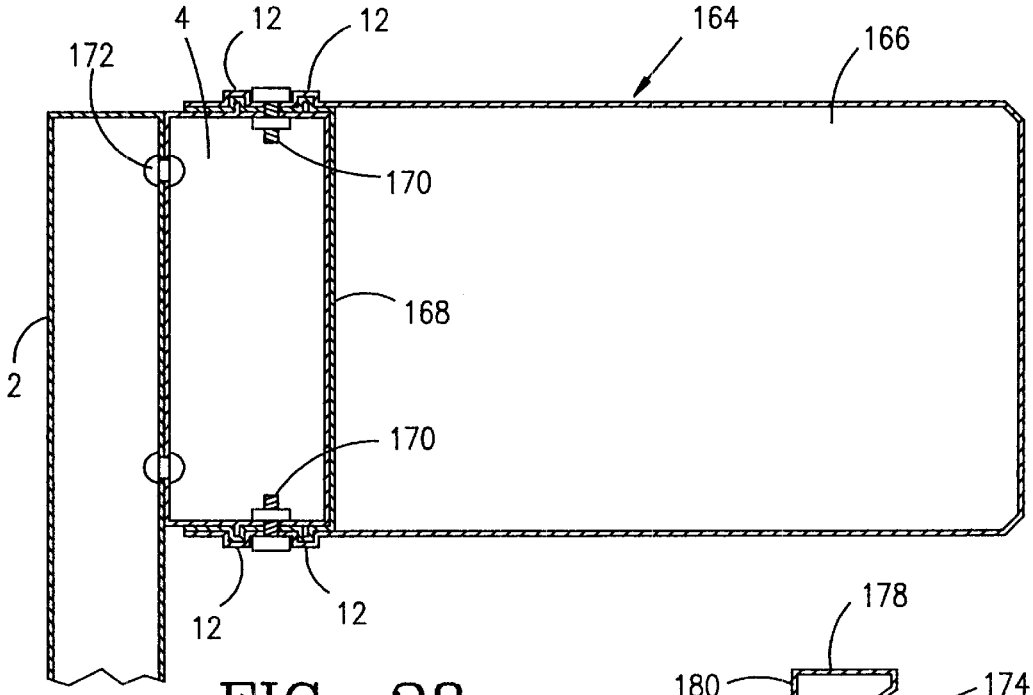
FIG. 28 is a cross-sectional view through another embodiment of a rail made in accordance with the present invention.

A rail 164 is disclosed in FIG. 28. The rail 164 is similar to the rail 154 except that the rail 164 is secured to the post 2 via spacer block 4. The rail 164 is also made from sheet metal comprising a U-shaped cross-sectional member 166 and another U-shaped cross-sectional member 168 joined together by connectors 12. Bolts 170 secure the rail to a standard spacer block 4. Bolts 172 or other standard means secure the standard spacer block 4 to the post 2.

Figure 29:
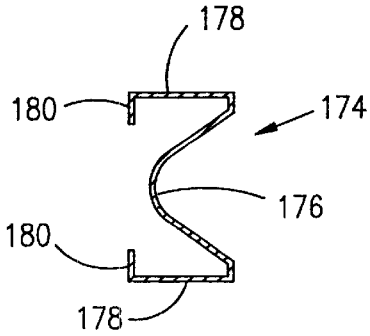
FIG. 29 is a cross-sectional view through yet another embodiment of a rail made in accordance with the present invention.

Another rail 174 made from sheet metal in accordance with the present invention is disclosed in FIG. 29. The rail 174 is substantially sigma-shaped. The rail 174 has a concave portion 176, a pair of horizontal side walls 178 and a pair of inwardly projecting flange portions 180.

The present invention addresses the prior art's W-beam rail's weakness at beam-acting by providing more of the material to be moved to the tensile, or away-from-traffic side or to the compressive, or near-traffic side of the W-beam. This provides for either a stronger W-beam section in bending or a reduction in cross-sectional area of the material used providing a more economic shape structurally. Additional benefits derive from a stronger section-modulus in the vertical plane thereby providing more stiffness to an impacting vehicle's attempt to squeeze-under or pull-down the rail component.

The rail of the present invention may be used with standard posts and spacers, or with the posts and spacers made in accordance with the present invention as described above.

Use of the post, spacer and rail made in accordance with the present invention results in either a more economic use of post material and/or block material and/or rail material in the manufacture of guardrail components and/or lower transportation costs for both raw and finished guardrail components and/or a reduction in the generation of scrap material due to vehicle accidents resulting in lower economic and/or environmental impact of vehicle accidents. For example, if the present invention's post component is configured in layers of high-strength steel sheet, the resulting net weight is less per post versus the present standard W6×8.5 guard rail post weight of 51 lbs., thus realizing a significant reduction in steel consumed. Additional economic benefits are recognized such as, but not limited to freight and handling costs. Utilizing a composite post design such as, but not limited to, plastic, fiberglass and cold-formed high-strength steel sheet would result in even greater reduction in steel consumption, handling costs and transportation costs.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. Post for a highway guardrail system, comprising:

a) a tube formed from sheet material;

b) said tube including overlapping portions;

c) a plurality of connectors to join said overlapping portions together; and d) said tube when installed is filled with soil substantially above the ground level.

2. Post as in claim 1, wherein said overlapping portions are disposed within said tube.

3. Post as in claim 1, wherein said overlapping portions are disposed outside said tube.

4. Post as in claim 1, wherein said tube is rectangular in cross-section.

5. Post as in claim 1, wherein said tube is trapezoidal in cross-section.

6. Post as in claim 1, wherein said connectors include protrusions projecting above a surface of said overlapping portions.

7. Post as in claim 1, wherein said tube is formed from sheet metal.

8. Post as in claim 1, wherein said tube is formed from plastic.

9. Post as in claim 1, wherein said tube is formed from fiberglass.

10. Post as in claim 1, wherein said tube includes first and second C-shaped members having extending outer portions forming said overlapping portions, said outer portions being joined together within said tube.

11. Post as in claim 1, wherein said tube includes a U-shaped member and a planar member each having corresponding outer portions forming said overlapping portions.

12. Post as in claim 11, and further comprising a plate joined to a surface of said tube.

13. Post as in claim 12, wherein:

a) said post includes a side disposed away from the traffic side of the highway; and b) said plate is secured to said side.

14. Post as in claim 12, wherein said plate extends along an intermediate portion of said tube.

15. Post as in claim 12, wherein said plate is disposed outside said tube.

16. Post for a highway guardrail system, comprising:

a) a tube formed from sheet material;

b) said tube including overlapping portions;

c) a plurality of connectors to join said overlapping portions together;

d) said tube including a U-shaped member and a planar member joined together at said overlapping portions;

e) a plate joined to a surface of said tube;

f) said tube including first and second inner corners; and g) first and second angle brackets disposed at respective said first and second inner corners.

17. Post as in claim 12, wherein said tube includes a through-bolt hole through said plate.

18. Post as in claim 1, wherein said tube includes first and second U-shaped members having extending outer portions forming said overlapping portions.

19. Post for a highway guardrail system, comprising:

a) a tube formed from sheet material;

b) said tube including overlapping portions;

c) a plurality of connectors to join said overlapping portions together;

d) a plate secured to a side of said tube;

e) said plate including a cut across its width; and f) said cut including a U-shaped portion.

20. Post for a highway guardrail system, comprising:

a) a tube formed from sheet material;

b) said tube including overlapping portions;

c) a plurality of connectors to join said overlapping portions together;

d) a plate secured to a side of said tube; and e) said plate including a cut across its width; and f) said cut including a V-shaped portion.

21. Post as in claim 1, wherein said tube is circular in cross-section.

22. Post as in claim 1, wherein said tube is formed from a ingle sheet metal.

23. Post as in claim 1, wherein said overlapping portions are adapted to be secured to a spacer.

24. Post as in claim 1, wherein:

a) said tube includes a through-bolt hole at a height above the ground line when said tube is installed in the ground; and b) said tube is filled with said soil substantially to the height of said through-bolt hole.

25. Post as in claim 10, wherein said C-shaped members are halves.

26. Post as in claim 12, wherein said plate is disposed within said tube.

27. Post as in claim 4, wherein:

a) said tube includes first and second corners; and b) first and second angle brackets disposed at respective said first and second corners.

28. Post as in claim 27, wherein said brackets are disposed within said tube.

29. Post as in claim 18, wherein said first and second U-shaped members are halves.

30. Post as in claim 1, and further comprising:

a) a plate secured to a side of said tube; and b) said plate includes a cut across its width.

31. Post as in claim 30, wherein said cut includes a U-shaped portion.

32. Post as in claim 30, wherein said cut includes a V-shaped portion.

33. Post for a highway guardrail system, comprising:

a) a tube formed from sheet material;

b) said tube including overlapping portions;

c) said tube including a U-shaped member and a planar member joined together at said overlapping portions;

d) said tube includes first and second corners formed at said overlapping portions with said planar plate; and e) first and second angle brackets disposed at respective said first and second corners.

34. Post as in claim 33, wherein said brackets are disposed inside said tube.

* * * * *